US007698824B2

(12) United States Patent
Wilson

(10) Patent No.: US 7,698,824 B2
(45) Date of Patent: Apr. 20, 2010

(54) HIGH PERFORMANCE SIGHTS

(76) Inventor: Keith W. Wilson, 304 Ash Rd., Tuckerton, NJ (US) 08087

( * ) Notice: Subject to any disclaimer, the term of this patent is extended or adjusted under 35 U.S.C. 154(b) by 355 days.

(21) Appl. No.: 11/434,255

(22) Filed: May 16, 2006

(65) Prior Publication Data

US 2007/0266573 A1 Nov. 22, 2007

(51) Int. Cl.
*F41G 1/467* (2006.01)

(52) U.S. Cl. ..... 33/265; 124/87

(58) Field of Classification Search ..... 33/265; 124/87, 90

See application file for complete search history.

(56) References Cited

U.S. PATENT DOCUMENTS

| | | | | |
|---|---|---|---|---|
| 4,011,853 | A * | 3/1977 | Fletcher | 124/87 |
| 4,656,747 | A | 4/1987 | Troncoso | |
| 4,833,786 | A | 5/1989 | Shores, Sr. | |
| 5,148,603 | A * | 9/1992 | Beutler | 33/265 |
| 5,157,839 | A * | 10/1992 | Beutler | 33/265 |
| 5,542,186 | A * | 8/1996 | Saunders | 124/87 |
| 5,579,752 | A | 12/1996 | Nelson et al. | |
| 6,016,608 | A * | 1/2000 | Lorocco | 33/265 |
| 6,131,295 | A | 10/2000 | Cranston | |
| 6,282,800 | B1 * | 9/2001 | Beutler | 33/265 |
| 2002/0073560 | A1 * | 6/2002 | LoRocco | 124/87 |
| 2003/0019118 | A1 | 1/2003 | Wilson | |
| 2006/0156561 | A1 * | 7/2006 | Afshari | 33/265 |
| 2007/0050998 | A1 * | 3/2007 | Myers | 33/265 |
| 2007/0157480 | A1 * | 7/2007 | Rager | 33/265 |

* cited by examiner

*Primary Examiner*—G. Bradley Bennett
(74) *Attorney, Agent, or Firm*—Richard C. Litman

(57) ABSTRACT

Bow and fixed firearm sights, employing fiber optic materials and tritium to provide illumination during periods of low-light, and no-light. As contemplated the bow sights are usable with or without an elastic alignment cord attached to the bow riser/limb and/or forward cable system of a compound bow. In its simplest form the bow sight comprises a bow sight having an opaque base, a transparent housing disposed on and integral with the base, a sight window having peripheral notches therearound and a fiber optic pin embedded in the transparent housing.

9 Claims, 25 Drawing Sheets

HIGH PERFORMANCE SIGHTS

BACKGROUND OF THE INVENTION

1. Field of the Invention

The present invention generally relates to sports equipment. More specifically, the present invention is drawn to high-performance sighting devices for target-practice for hunting bows and fixed sight firearms.

2. Description of the Related Art

Utilizing a bow, or firearm for hunting and/or target shooting is very popular to a growing segment of the sporting population. Heretofore, the use of bows and firearms for hunting has been limited in the early morning or evening hours when natural light is low. Since most jurisdictions prohibit the use of flashlights or the like, bow and firearm hunting has been virtually non-existent without high performance sights at these hours. An efficient bow or firearm sight that is extremely effective in normal daylight hours and, in low-light or, in no-light scenarios would certainly be a welcome addition to the art.

The related art, as identified and cited in the accompanying IDS, is replete with bow and firearm sights. However, none of the above identified and cited inventions and patents, taken either singly or in combination, is seen to disclose fiber optic sights, and fiber optic sights combined with tritium sights as will be subsequently described and claimed in the instant invention.

SUMMARY OF THE INVENTION

The present invention is directed to bow and firearm sights employing fiber optic materials, as well as tritium to provide illumination during periods of light, low-light, and no-light. Unique to the invention is the utilization of fiber optics for sighting on a bow drawstring and the creation of shaped sight windows within the sight base. As contemplated, the bow sights are usable with or without an elastic cord alignment cord attached to the bow handle and/or bow string. In its simplest form the bow sight comprises a bow sight having an opaque base, a housing (machined aluminum, injection molded fiber optic resin material, or transparent acrylic) disposed on and integral with the base, a sight window having peripheral notches therearound and a fiber optic pin, and tritium embedded in the transparent housing. On the rear bow sights contained herein, the fiber optic sight pins can utilize optional fiber optic sight pins in which tritium is encased directly within the same respective fiber optic strands. Other variations and embodiments will be disclosed below.

Accordingly, the invention presents unique bow and firearm sights that are efficient and easy to use. The invention provides for improved elements thereof in an arrangement for the purposes described that are inexpensive, dependable and fully effective in accomplishing their intended purposes.

A clear understanding of the present invention will become readily apparent upon further review of the following specifications and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
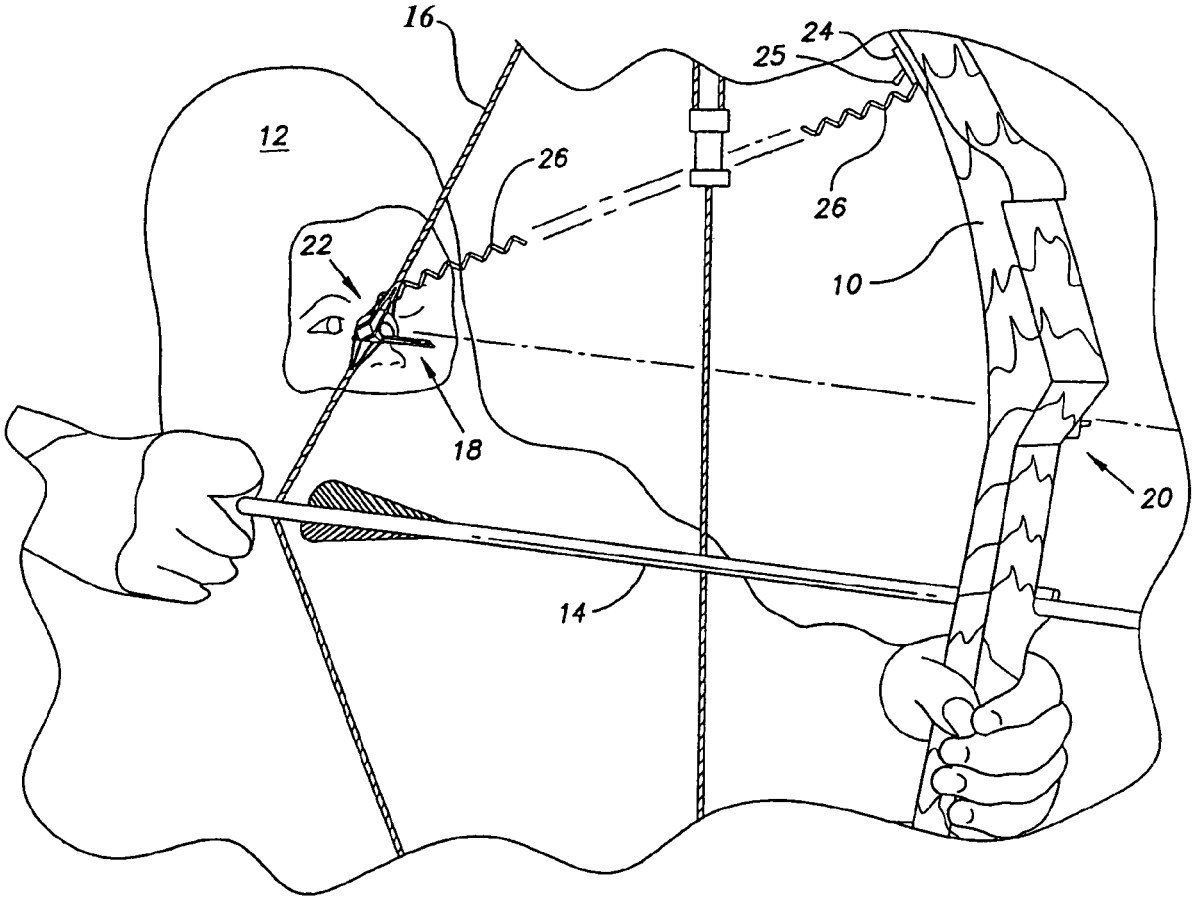
FIG. 1 is an environmental, perspective view of a first embodiment of a rear bow sight mounted on the bowstring according to the present invention.

Attention is first directed to FIG. 1, which shows a compound hunter's bow 10 with a hunter 12 drawing an arrow 14 on a bowstring 16 and sighting through a rear sight 18 and a forward sight pin 20. The device 18 is illuminated in situ with a light source 22 such as a light emitting diode (LED) energized by a battery (not shown) such as a silver oxide or lithium battery. The battery is in a casing 24. A coiled electrical cord 26 extends from casing 24 to the sight 18. A quiet on/off switch 25 is operative to activate rear sight 18.

Figure 2A:
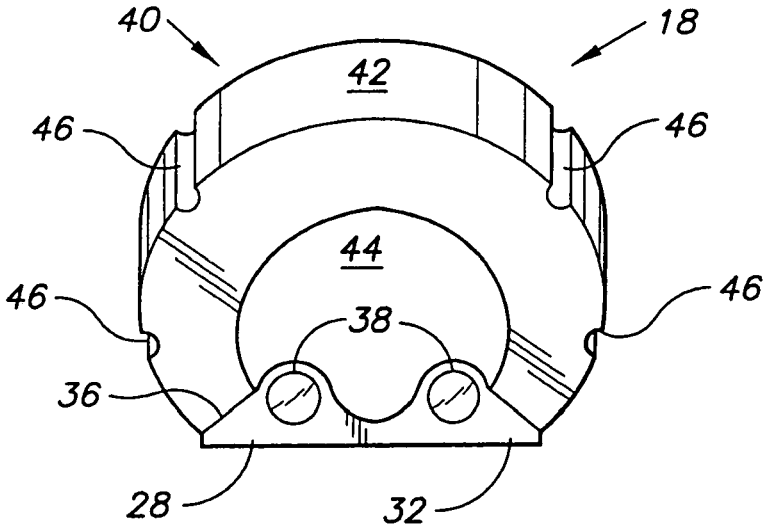
FIG. 2A is a front elevational view of the first embodiment of the present invention having a parallel pair of fiber optic sight pins embedded in the base which supports a sight window with four external notches for the separated strands of the bowstring.
Figure 2B:
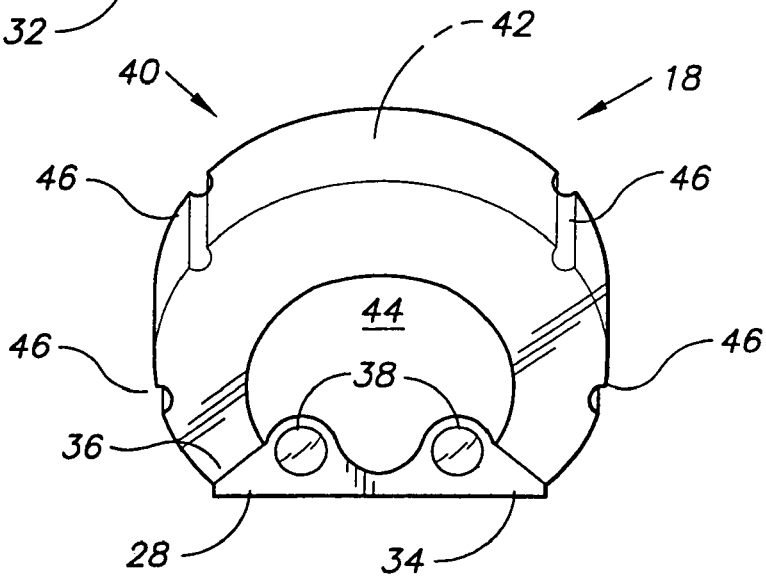
FIG. 2B is a rear elevational view of the first embodiment of the present invention.
Figure 2C:
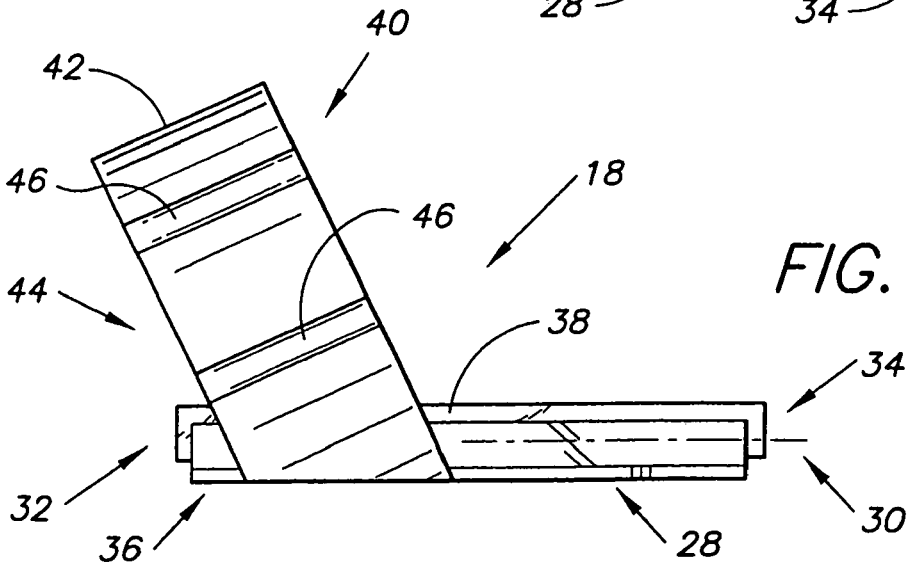
FIG. 2C is a side elevational view of the first embodiment of the present invention.

Turning to FIGS. 2A to 2C, the first embodiment of a transparent rear bow sight 18 has a rectangular planar opaque base 28 having a longitudinal axis 30 (FIG. 2C), a front end 32 and a rear end 34. The base 28 is preferably made from aircraft grade aluminum 6061-T6, then anodized for yet further protection against weathering elements. The base anodized 36 contains partially embedded on its top surface a parallel pair of straight colored fiber optic pins 38 which are stiff clear plastic compositions containing tritium. The sight pins 38 can vary in diameter, as in colors. The smaller diameters of sight pins are the preferred. As to the alternative colors of the fiber optic sight pins, and tritium night sights, many alternatives can apply, however; yellow and green have proven to perform the best, and are the preferred. Alternatively, a single colored fiber optic pin could be used, but the accuracy of aiming is enhanced by using two parallel fiber optic pins. The base 28 can be another metal or any type of a composite material such as machined Delrin plastic, acrylic, and the like.

Figure 4A:
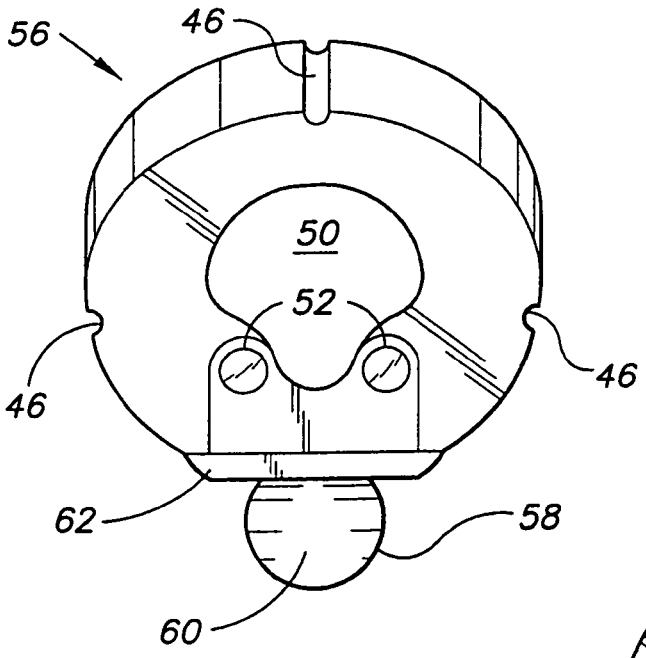
FIG. 4A is a front elevational view of a third embodiment of the present invention having a U-shaped fiber optic sight pin, a base post, and a sight window with three spaced notches for the bowstring strands.

A transparent circular sight window portion 40 made of acrylic plastic, or from injection-molded fiber optic resin material, has a rim 42 enclosing an enlarged aperture 44. Sight window portion 40 is positioned proximate the front end 32 of the base 28, and inclined towards the end 32 at a specific angle in the range of 60 degrees to 70 degrees. The opening 44 can be 7/16 inch in diameter. The rim 42 has a plurality of spaced external notches 46 coincident with its central axis Three notches 46 are depicted in FIGS. 4A, & 4C, but can number two as a minimum for equally grouping the strands of the bowstring in each notch. Furthermore, it should be noted that the notches 46 located in FIGS. 2A, & 2C, embodiment are spaced such that the upper two notches 48 have a wider spacing than the lower notches from the upper notches. It has been found that this arrangement enhances a more secure placement of the sight on the bowstring 16.

Figure 3A:
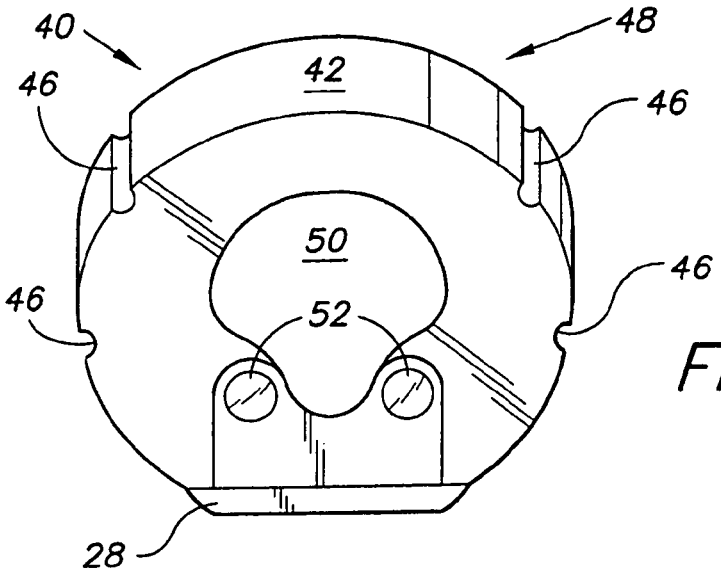
FIG. 3A is a front elevational view of a second embodiment of the present invention having a U-shaped fiber optic sight pin and a sight window with four spaced notches for the separated bowstring strands.
Figure 3B:
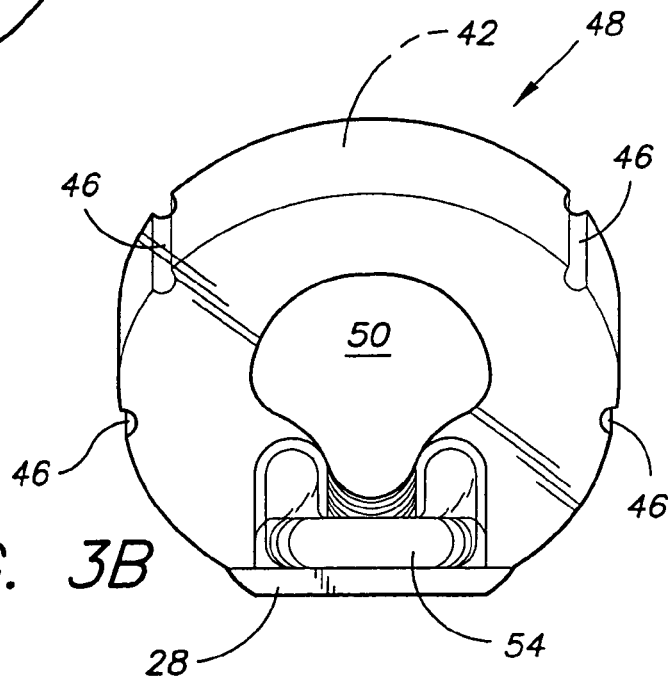
FIG. 3B is a rear elevational view of the second embodiment of the present invention.
Figure 3C:
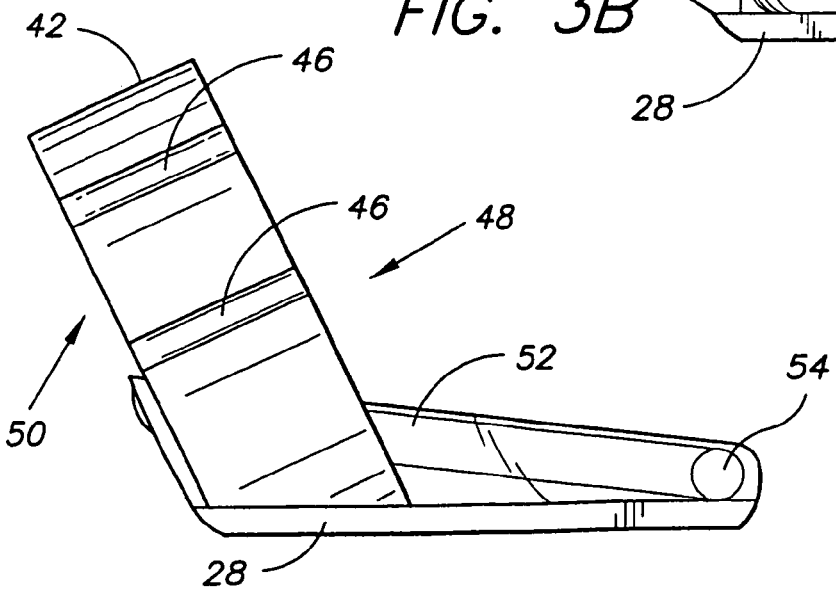
FIG. 3C is a side elevational view of the second embodiment of the present invention.

In FIGS. 3A, 3B and 3C, a second embodiment of a rear transparent bow sight 48 is illustrated. The aperture 50 has been shaped to dip between the colored fiber optic pins 52 which are now inclined upward toward the sight window 40 and joined to a U-shaped configuration 54. These pins are made from flexible plastic compositions. It has been found that the inclination of the pins 52 on the rectangular opaque base 28 aids in a better view without a part of the optic sight 48 obstructing the hunter's view.

Figure 4B:
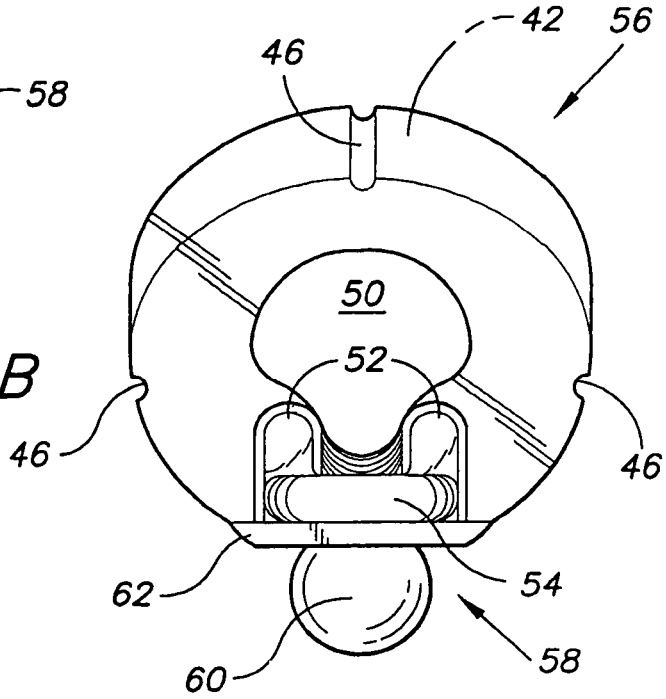
FIG. 4B is a rear elevational view of a third embodiment of the present invention.
Figure 4C:
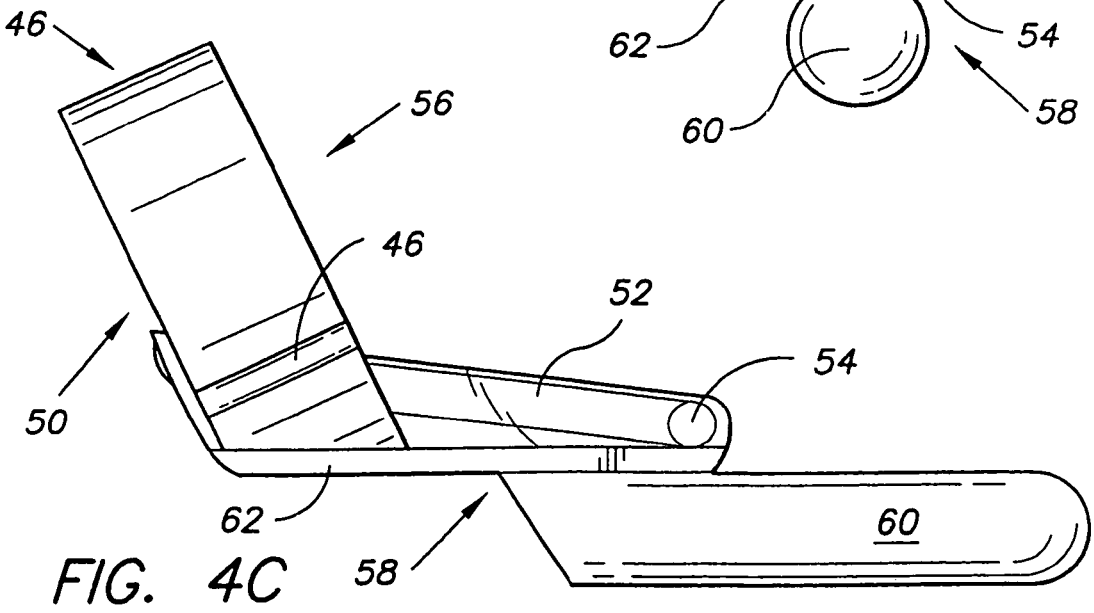
FIG. 4C is a side elevational view of a third embodiment of the present invention.

In FIGS. 4A, 4B and 4C, a third embodiment of a rear transparent bow sight 56 is illustrated. The notches 46 have been reduced to three in number to accommodate a division of three strands, wherein two strands are a minimum for this type of sight. It has been found that the lesser the division of strands of a bowstring, the better the visibility through the sight. The base 58 is configured as a cylindrical rod 60 supporting a planar portion 62, and the rod 60 has been shifted to the rear end of the bow sight 56.

Figure 5A:
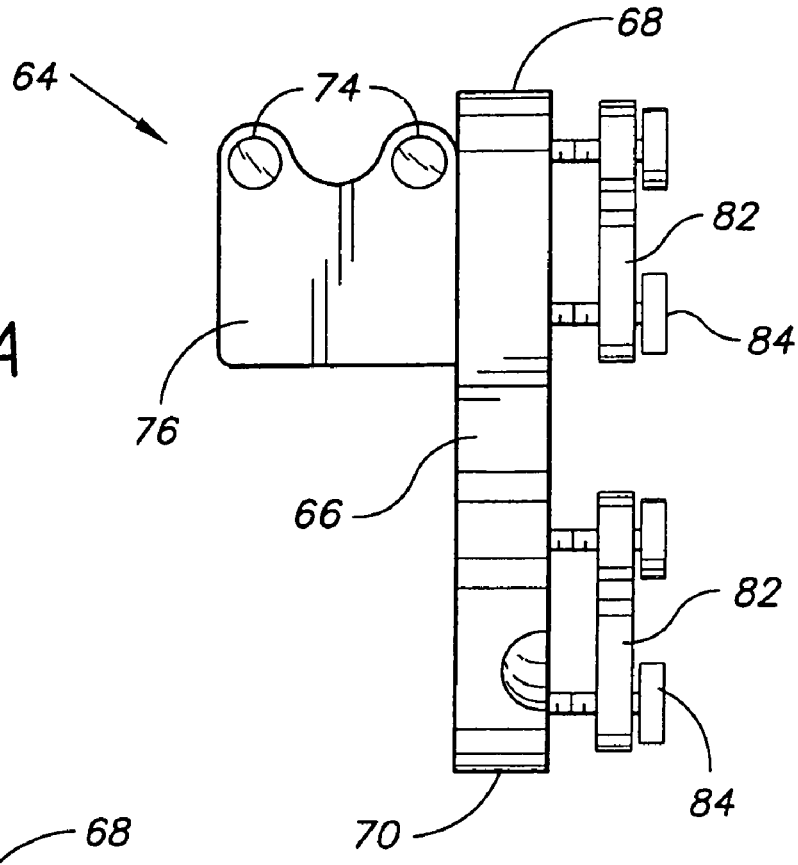
FIG. 5A is a front elevational view of a fourth embodiment of the present invention having a rectangular planar opaque base with an opaque T-shaped support for a U-shaped fiber optic pin on an upper side and a groove in the bottom for securing the bowstring with a pair of clamp bars.
Figure 5B:
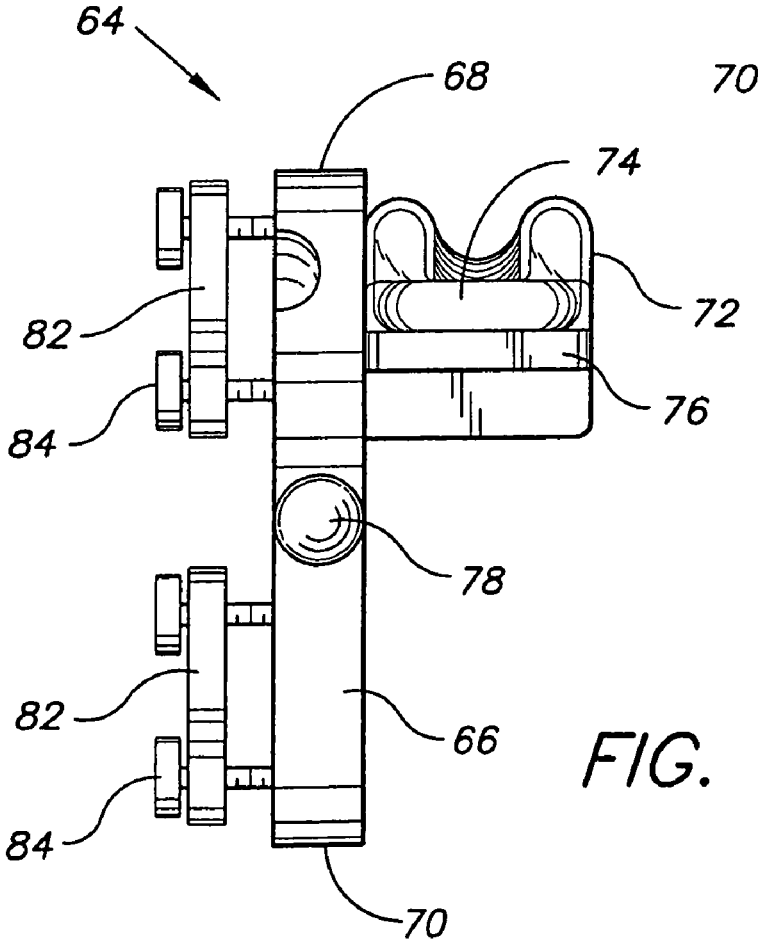
FIG. 5B is a rear elevational view of the fourth embodiment of the present invention.
Figure 5C:
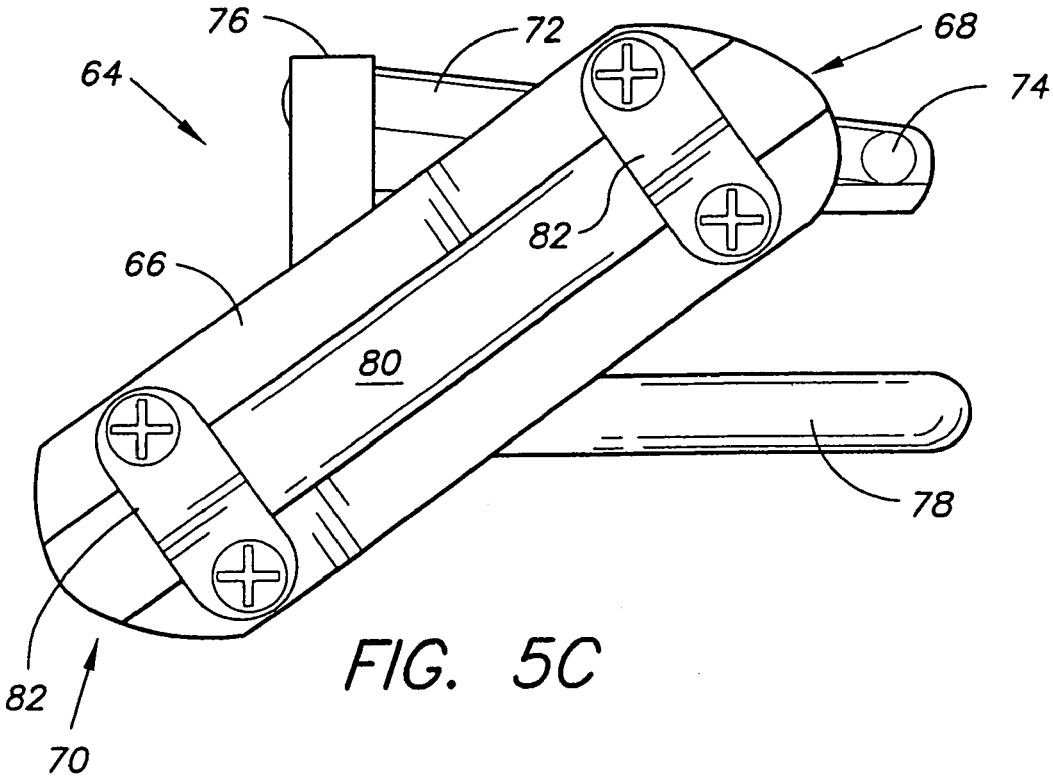
FIG. 5C is a right side elevational view of the fourth embodiment of the present invention.
Figure 5D:
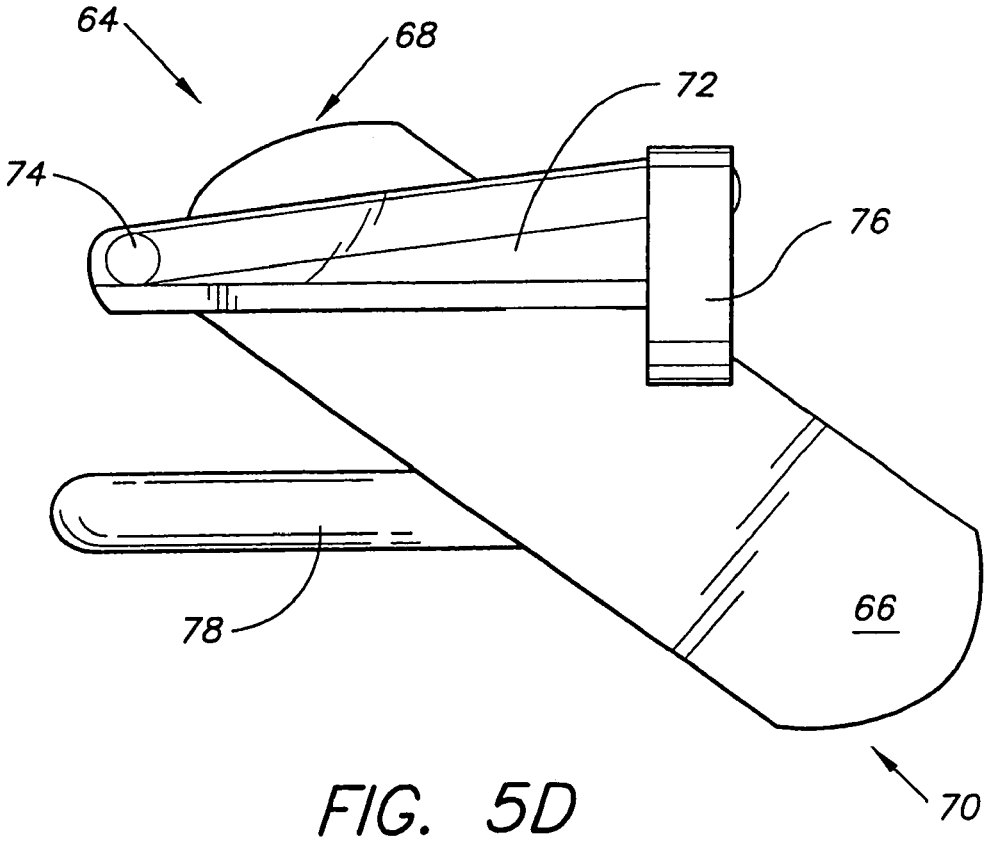
FIG. 5D is a left side elevational view of the fourth embodiment of the present invention.

In FIGS. 5A, 5B, 5C, and 5D, a fourth embodiment of an offset rear transparent fiber optic bow sight 64, which is clamped vertically onto the bowstring, is illustrated. A substantially rectangular planar opaque base 66 has a longitudinal axis, a top end 68 and a bottom end 70. An elongated transparent housing 72 made of acrylic plastic contains a U-shaped colored fiber optic pair of pins 74 integral and aligned with a rectangular opaque T-shaped support 76 (FIG. 5D), attached to the base 66 by any fastening means such as an adhesive. The pins 74 are intentionally misaligned at an angle of approximately 45 degrees to the horizontal longitudinal axis of the base 66 (FIGS. 5C, and 5D). The T-shaped support 76 is also parallel to an opaque post 78 extending from approximately the center of the support 76. The post 78 is utilized to attach a rubber tubing (not shown) to the bow, or forward cable system, for alignment purposes as is conventional in the archery art.

A groove 80 in the bottom of the base 66 accepts the bowstring, which is clamped down by a pair of clamp bars 82 fastened to the base 66 by fasteners 84. Alternatively, a single centered clamp bar 82 can be used. By routine experimentation, the best position for this bow sight 64 can be determined and the base 66 clamped securely to the bowstring.

Figure 6A:
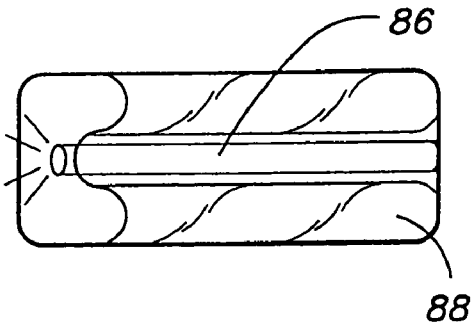
FIG. 6A is a top plan view of a fifth embodiment of a bow sight with a single straight fiber optic sight pin.
Figure 6C:
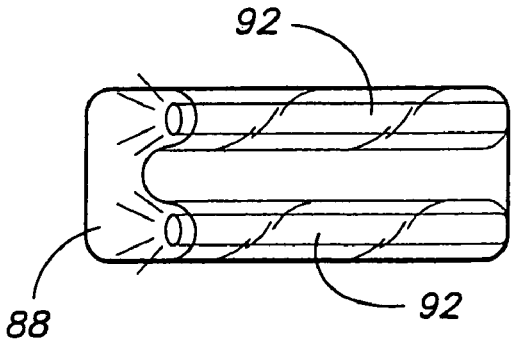
FIG. 6C is a top plan view of a seventh embodiment of a bow sight with two straight and parallel fiber optic sight pins.
Figure 6B:
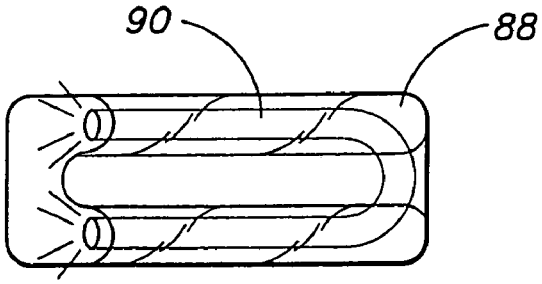
FIG. 6B is a top plan view of a sixth embodiment of a bow sight with a single U-shaped fiber optic sight pin.
Figure 6D:
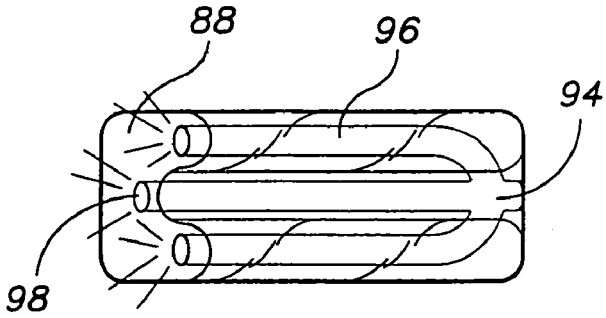
FIG. 6D is a top plan view of an eighth embodiment of a bow sight with three fiber optic sight pins comprising a centered straight pin intersecting a U-shaped sight pin.

In the fifth to eighth embodiments of FIGS. 6A, through 6D, respectively, various configurations of the colored fiber optic strands of a rear transparent bow sight are illustrated. The fifth embodiment of FIG. 6A, shows a single straight colored fiber optic pin 86 encased in a transparent acrylic housing 88. The sixth embodiment of FIG. 6B, depicts a U-shaped colored fiber optic pin 90 encased in a housing 88. The seventh embodiment of FIG. 6C illustrates two straight and parallel fiber optic pins 92 encased in a housing 88. Finally, the eighth embodiment of FIG. 6D, shows a combination colored fiber optic strands 94 encased in a housing 88, wherein a U-shaped pin 96 is intersected by a straight pin 98 which is parallel to the legs of the U-shaped pin 96. In the configurations illustrated in FIGS. 6A, through 6D, the hunter has a choice of which fiber optic configuration is best for him or her.

Figure 7:
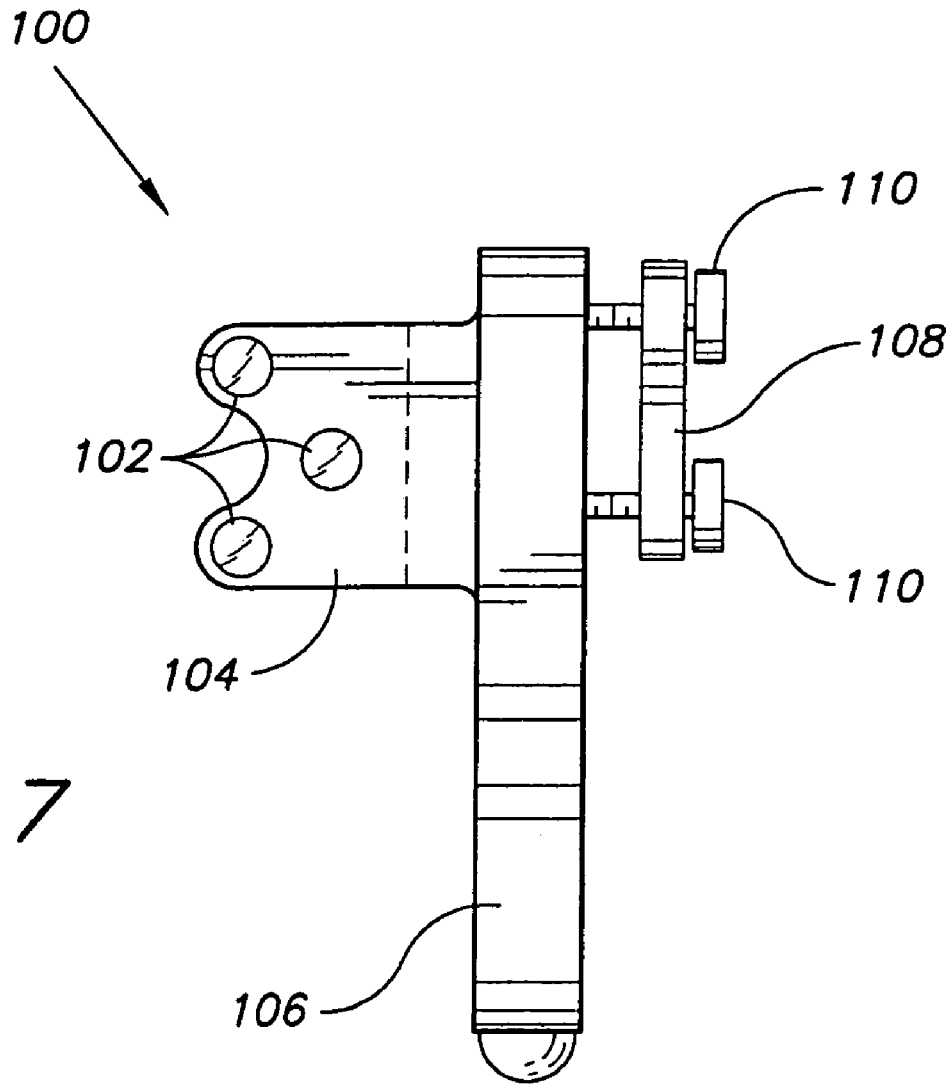
FIG. 7 is a side elevational view of a ninth embodiment of a bow sight with three parallel fiber optic sight pins with the center fiber optic sight pin not in line with the other two sight pins.

In the ninth embodiment of FIG. 7, the bow sight 100 is shown in a front elevational view as positioned on a bowstring for a right-handed archer. Bow sight 100 has three parallel colored fiber optic sight pins 102 in a transparent housing 104 with the center pin not in line with the other two outside pins. The housing 104 is attached perpendicularly to the opaque base 106. The base 106 is attached to the bowstring by a single clamp 108 and a pair of fasteners 110.

Figure 8:
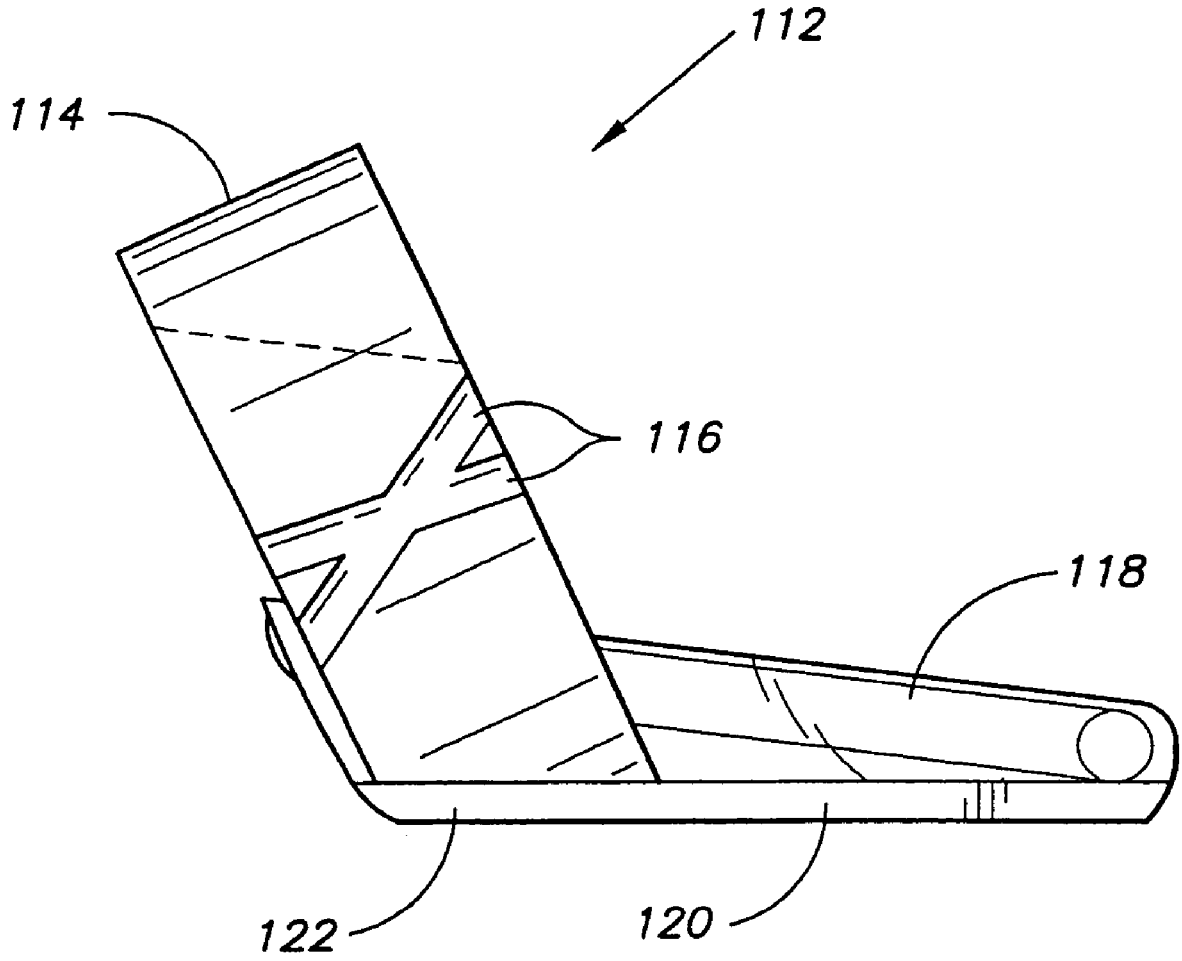
FIG. 8 is a side elevational view of a tenth embodiment of a bow sight with two intersecting notches on opposite sides of the sight window.

In the tenth embodiment of FIG. 8, the bow sight 112 has an inclined sight window 114 with two intersecting notches 116 on opposite sides of the sight window for attaching the bowstring. These notches 116 allow this sight to be positioned at two different angles to be properly set on a bowstring for a short (more inclined notch) or a long draw length for a specific archer. The intersecting notches can be applied to all other aforementioned embodiments wherein sights are attached to a bowstring. A U-shaped colored fiber optic pin 118 is inclined upward in a transparent housing 120 positioned on an opaque base 122. This arrangement enhances the stability of the bow sight 112.

Figure 9A:
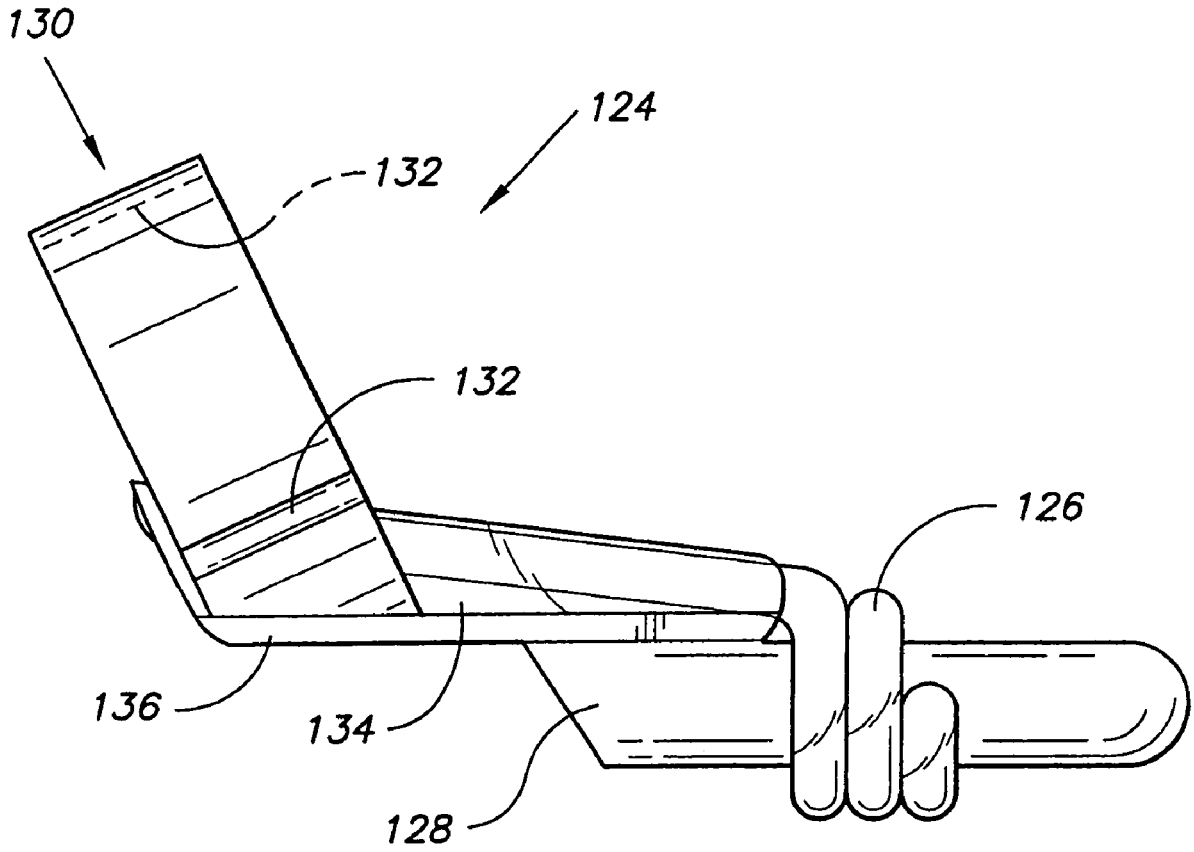
FIG. 9A is a side elevational view of an eleventh embodiment of a bow sight having an inclined sight window and a coiled fiber optic pin around an aligned post.

In the eleventh embodiment of FIG. 9A, the bow sight 124 has a single colored fiber optic pin 126 coiled initially around an aligned post 128 approximately twice to maximize the available light. The sight window 130 has three notches 132 spaced 120 degrees apart with the middle notch on top. The window 130 is inclined away from the coils on an opaque rectangular base 134 and includes a transparent housing 136 having the straight portion of the fiber optic pin 126 inclined upward.

Figure 9B:
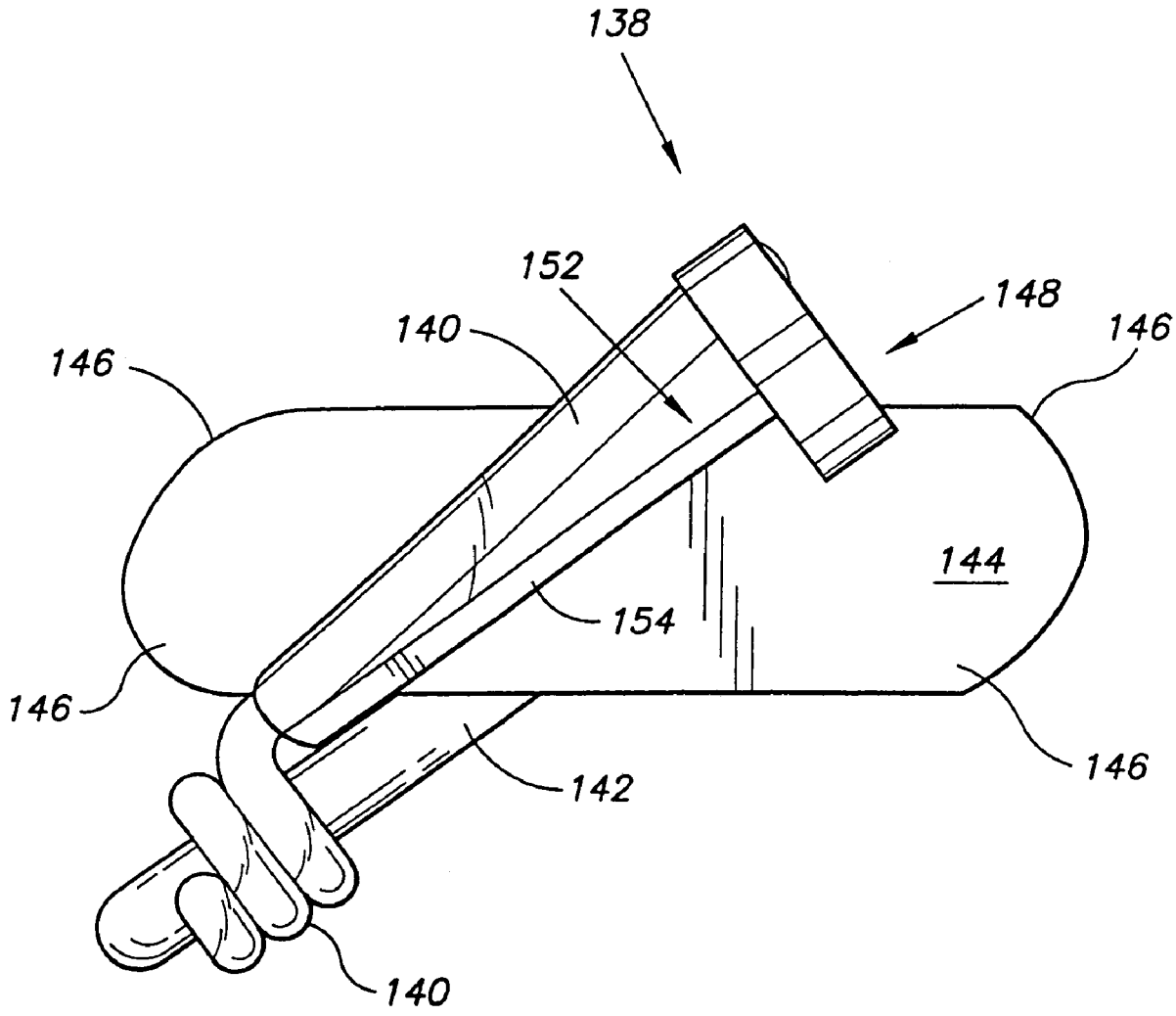
FIG. 9B is a top plan view of a twelfth embodiment of a bow sight having a perpendicular sight window and a skewed post around which is coiled the fiber optic pins.

In the twelfth embodiment of FIG. 9B, the bow sight 138 has a similar single colored fiber optic pin 140 coiled around a post 142 at one end which is skewed approximately 40 degrees from a substantially rectangular primary base 144 with round corners 146 and on its bottom a groove and clamp bars similar to those shown in FIG. 5C. The sight window 148 is positioned similar to that in FIG. 9A. However, the sight window 148 is positioned perpendicularly on the primary base 144 and skewed relative to the longitudinal axis of the base 144. The transparent housing 152 is positioned on a smaller secondary opaque base 154 and houses the straight portion of the colored fiber optic pin 140 along one side. The coiling aspect of the colored fiber optic pin can be applied to all the other aforementioned embodiments to improve their light gathering. Also, the addition of tritium gas inside each colored optic sight pin enhances the gathering of light in every embodiment.

Figure 10:
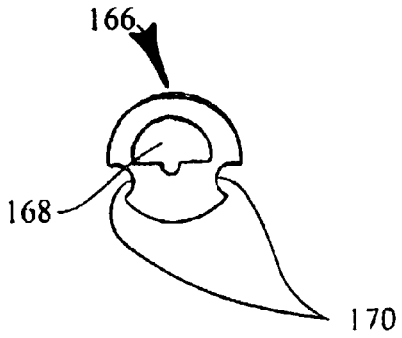
FIG. 10 is a front view of a thirteenth embodiment of a bow sight according to the present invention.
Figure 10A:
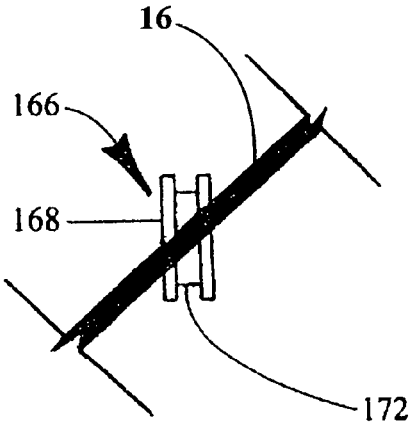
FIG. 10A is a side elevational view of a thirteenth embodiment of a bow sight according to the present invention.
Figure 10B:
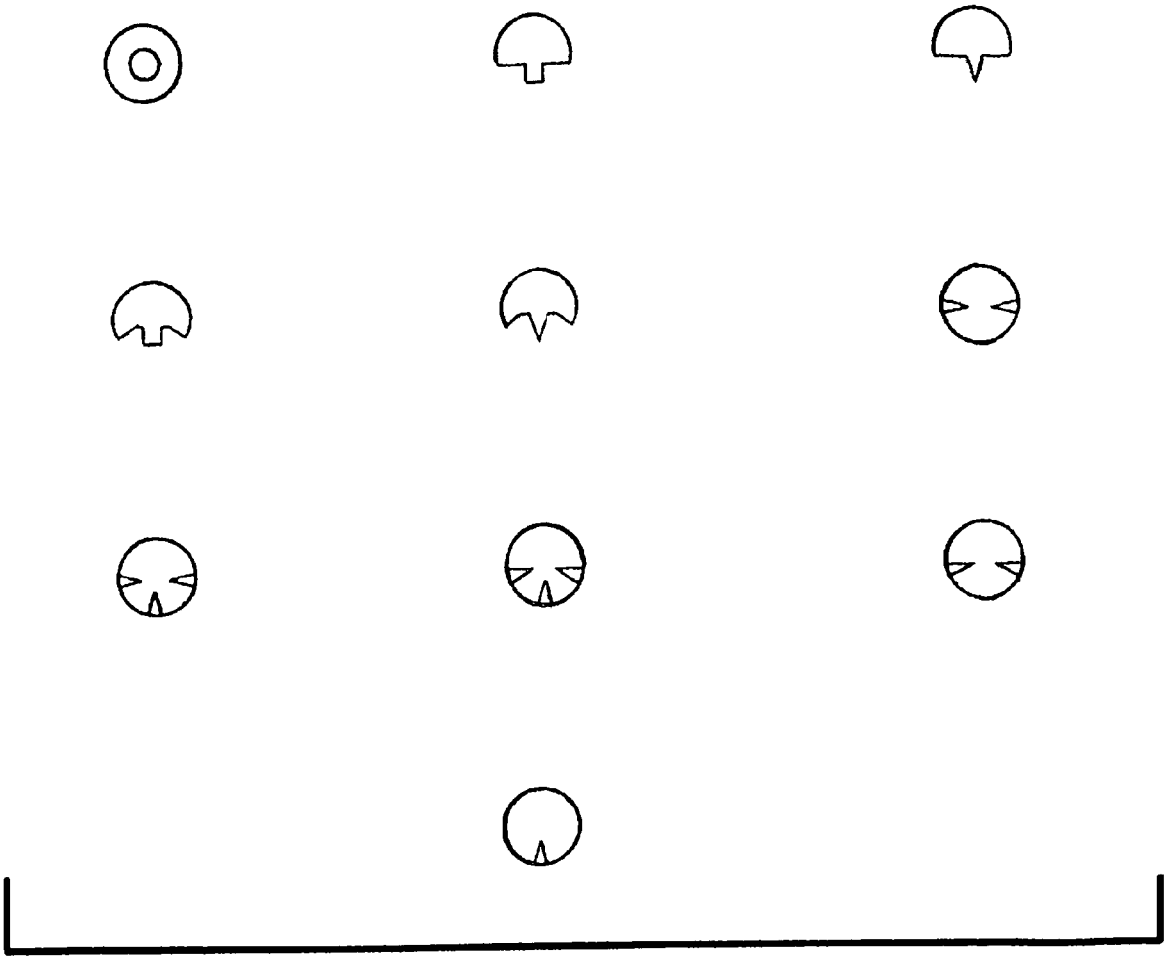
FIG. 10B shows various sight configurations that the thirteenth embodiment can assume.

Attention is now directed to FIG. 10, thru FIG. 10B, which is shown to encompass yet another embodiment of the present invention. This embodiment utilizes injection molded fiber optic resin materials, thus enabling the fabrication of various shaped sight windows. When complete, each sight is a one piece sight, constructed entirely of fiber optic resin materials. FIGS. 10, and 10A show the sight, encompassing this new thirteenth embodiment. FIG. 10 shows bow sight 166 in a front elevational view, wherein the shaped sight window 168 is directly facing the bow shooter's eye when the bow is in a firing position, or at full draw. FIG. 10A, shows a side elevational view of this same sight 166 attached to a bowstring 16, shown at an angle when at full draw. Angled notches 170 are provided on the outside edges of the base so as to allow the sight window to be perpendicular to the shooters eye when at full draw. The notch 172 goes around the periphery of the base for secure bowstring placement. FIG. 10B shows optional sight window configurations that can be fabricated from injection molded fiber optic resin materials. The inside optional shaped sight windows are illuminated by the ambient light in which to sight thru for good target acquisition.

Additionally, tritium night sights can be embedded within the sight base to yet further enhance sighting potential.

Figure 11A:
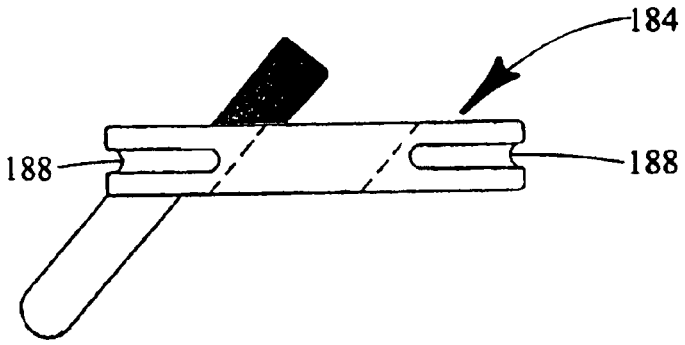
FIG. 11A is a side elevational view of a fourteenth embodiment of a bow sight according to the present invention.
Figure 11:
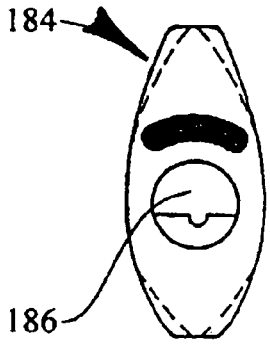
FIG. 11 is the front view of a fourteenth embodiment of a bow sight according to the present invention.
Figure 11B:
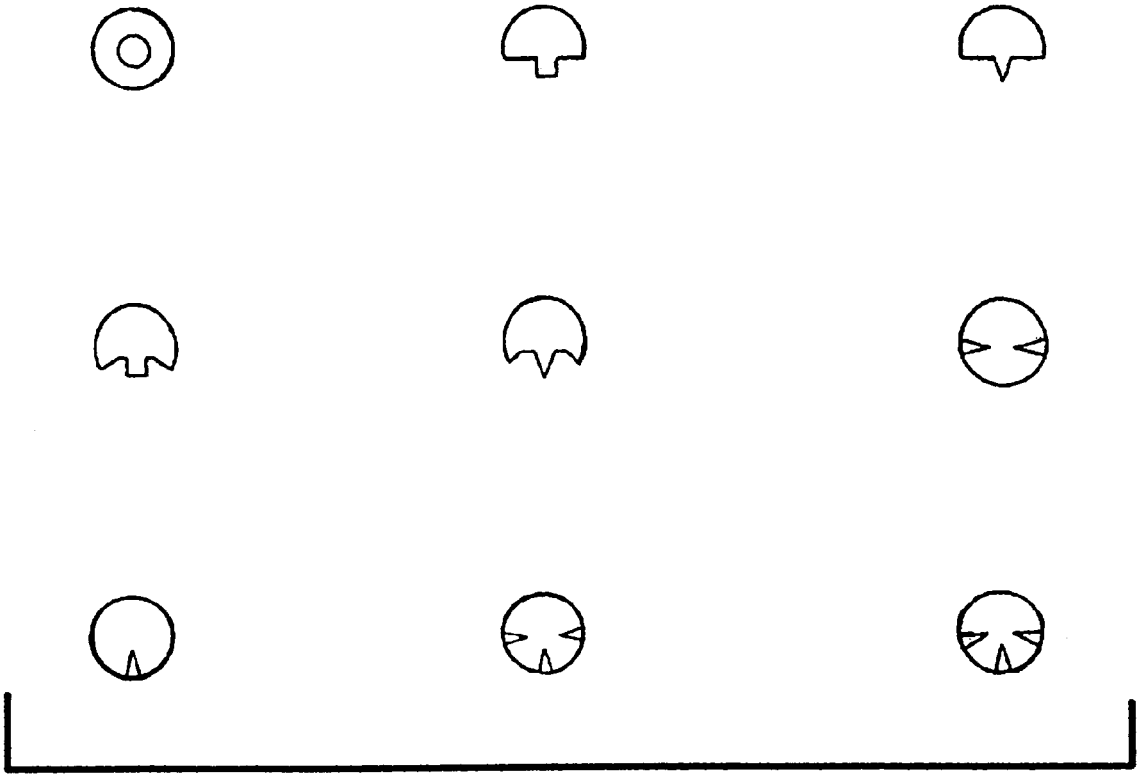
FIG. 11B shows various sight configurations that the fourteenth embodiment can assume.

Another style or type of sight in which injection molded fiber optic resin materials is utilized is shown in FIGS. 11 and 11A. FIG. 11 shows a front view of sight 184 wherein the shaped sight window 186 is directly facing the bow shooter's eye when the bow is in a firing position, or at full draw. FIG. 11A shows a side elevational view of this sight, in which notches 188 are provided on the outside edges of the base so as to allow the sight window to be perpendicular to the shooters eye when at full draw. The notch 188, on the outside edge of the periphery of the base, is for securing bowstring placement. Sight 184 can be fabricated to assume various shaped sight windows as shown in FIG. 11B. Additionally, tritium night sights can be embedded within the sight base to yet further enhance sighting potential.

Figure 12:
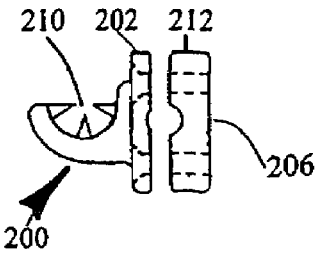
FIG. 12 is a front view of a fifteenth embodiment of a bow sight, which is affixed externally to the bowstring, according to the present invention.
Figure 12B:
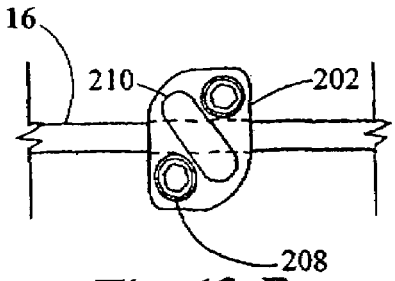
FIG. 12B is a side elevational view of FIG. 12 of a fifteenth embodiment of a bow sight, shown mounted on a bowstring according to the present invention.
Figure 12A:
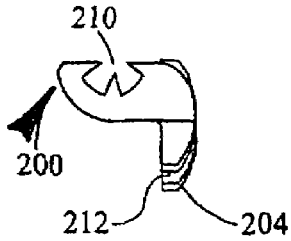
FIG. 12A is a front view of a fifteenth embodiment of a bow sight, which is affixed within two equal divisions of the bowstring, according to the present invention.
Figure 12C:
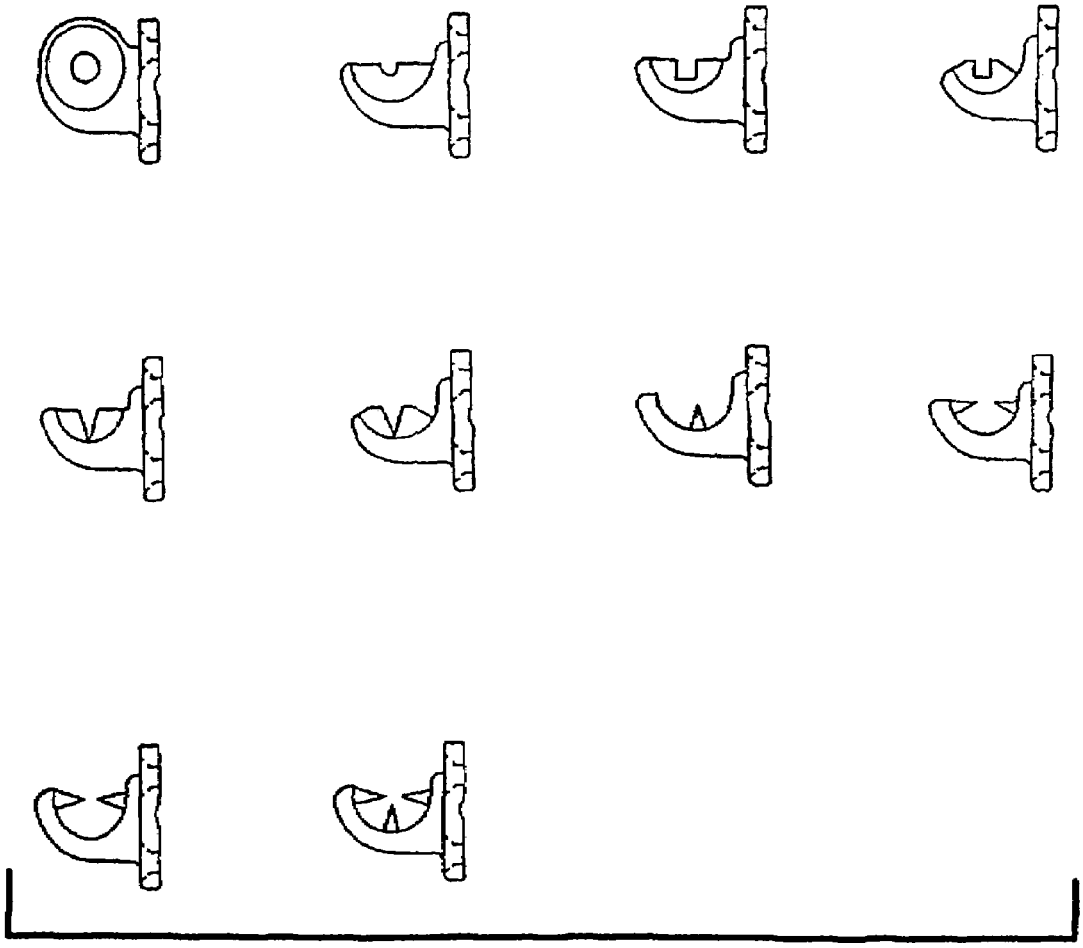
FIG. 12C shows various sight configurations that the fifteenth embodiment can assume.

Another style or type of sight in which sights are fabricated from injection molded fiber optic resin materials is utilized is shown in FIGS. 12-12B. FIGS. 12 and 12A show a sight 200 wherein shaped sight windows 210 is directly facing the bow shooter's eye when the bow is in a firing position, or at full draw. FIG. 12 shows a front view of sight 200 and a clamp plate 206. FIG. 12B shows a side elevational view of sight 200 mounted to the bowstring 16 by utilizing a clamp plate 206 attached to a base 202. Two fasteners 208 are employed to accomplish attachment. FIG. 12A shows sight 200 with a base 204 supporting a notch 212 around the periphery. Notches 212 are shown for securing bowstring placement. Sight 200 can be fabricated to assume various shaped sight windows as shown in FIG. 12C. Additionally, tritium night sights can be embedded within the sight base to yet further enhance sighting potential.

Figure 13:
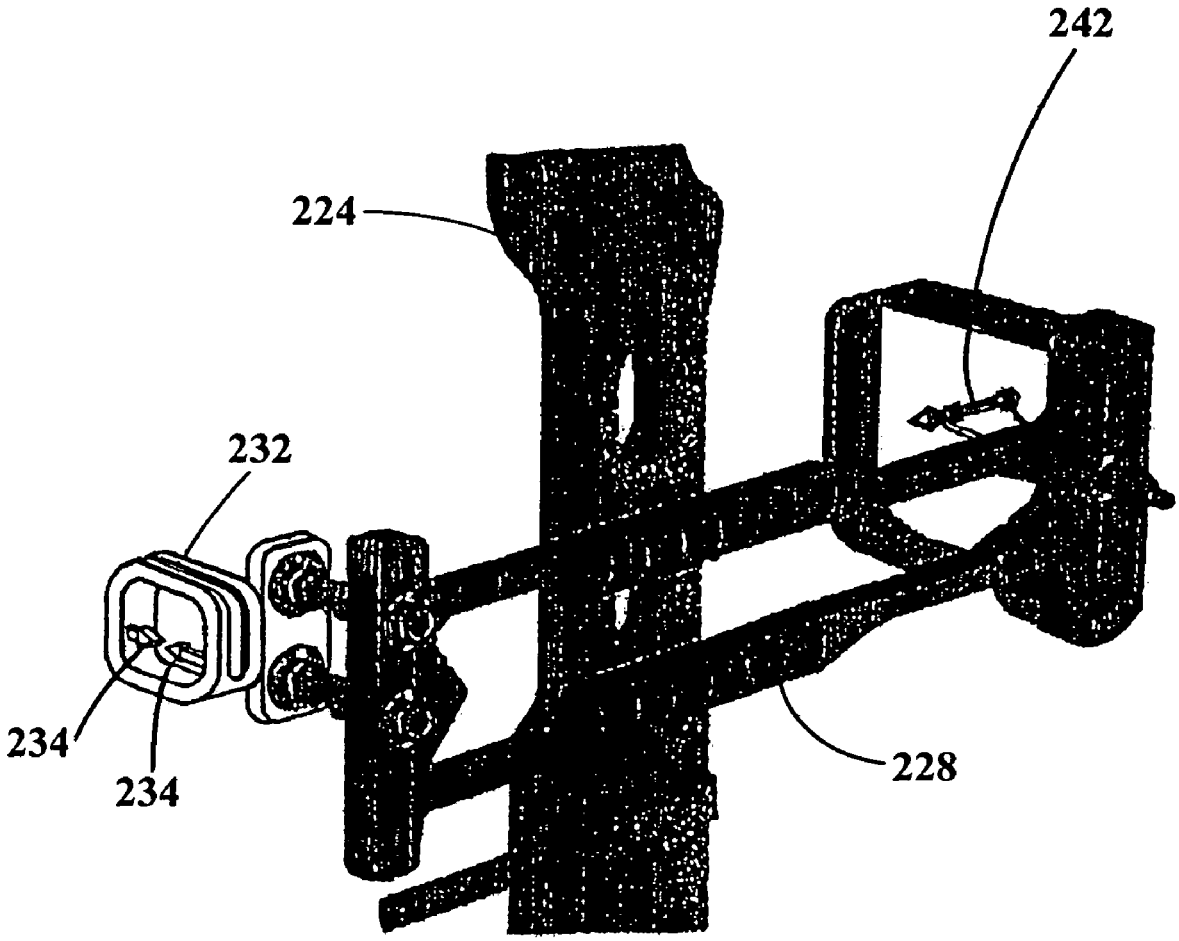
FIG. 13 is a perspective view of a sixteenth embodiment of a sight arrangement mounted to a universal mounting bracket according to the present invention.

Rather than mounting these sights on the bowstring, the sights which are fabricated from injection molded fiber optic resin materials, can be mounted on universal mounting brackets, which brackets can either be attached to the bow riser, or to the cable guard. FIG. 13, shows a typical universal mounting bracket 228, attached to the bow riser 224. An injection molded sight employs a one piece, wherein each end is fabricated into two triangularly shaped sight members 234. The triangular shaped sight naturally draws the eye toward the center for optimum rear to forward sight alignment. The members 234 are held in proper position and are supported in a housing 232. Housing 232 is fabricated from 6061-T6 aircraft grade aluminum, then anodized. Sights 234, are utilized with a forward sight 242. Pin 242 (also fabricated from injection molded fiber optic resin materials) is triangular in shape at the end pointed to the viewer. Rear sight window options can take on configurations similar to those as shown in FIG. 12C. This new forward bow sight pin works well with all sights listed within this package.

Figure 14:
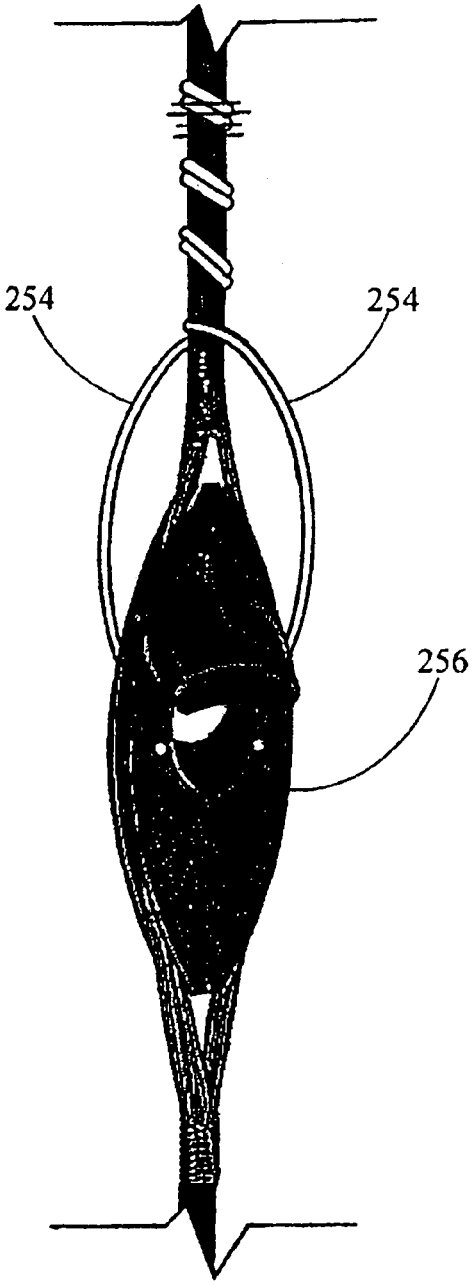
FIG. 14 is a partial view of a seventeenth embodiment of a bow sight, whereas the sight window is centered within the sight base, it shows the fiber optic strands wrapped around the bowstring above the sight according to the present invention.
Figure 15:
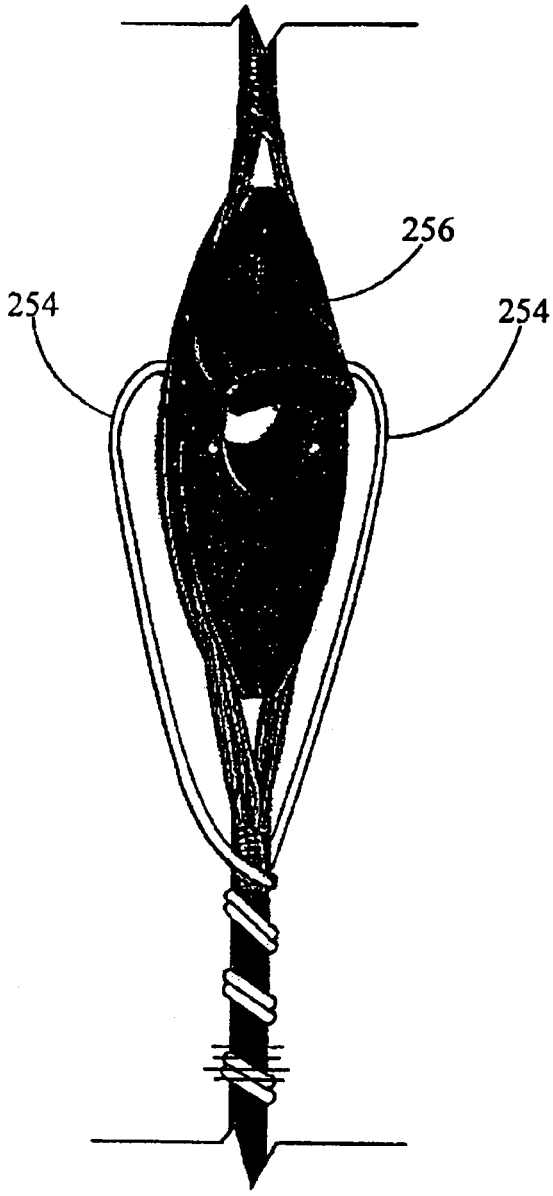
FIG. 15 is a partial view of a seventeenth embodiment of a bow sight showing the fiber optic strands wrapped around the bowstring below the sight according to the present invention.
Figure 16:
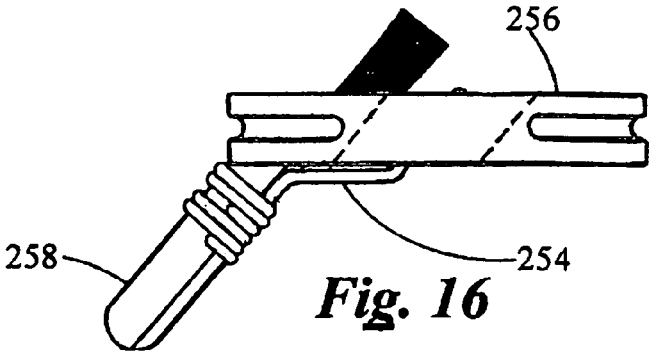
FIG. 16 is a side elevational view of a seventeenth embodiment of a bow sight showing the fiber optic strands wrapped around the sight alignment post of the sight according to the present invention.
Figure 17:
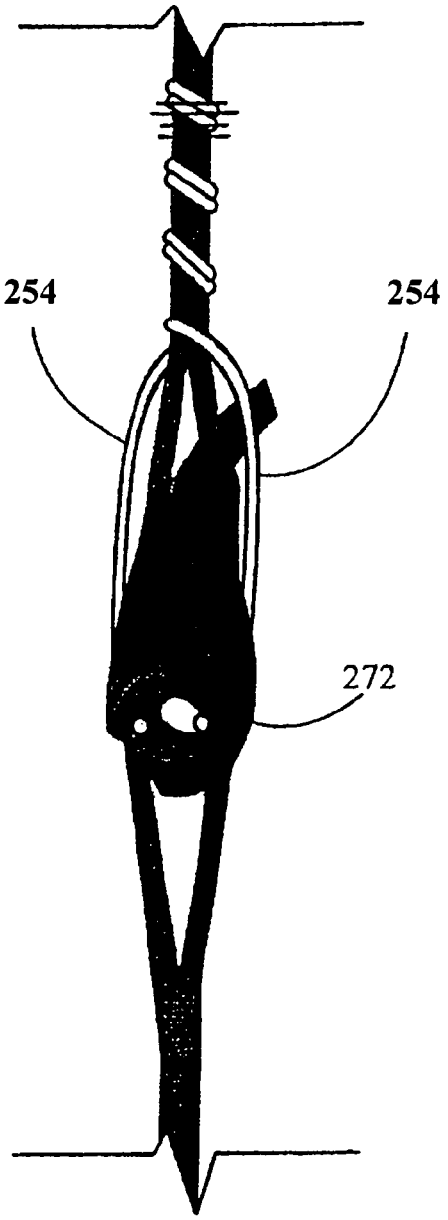
FIG. 17 is a partial view of an eighteenth embodiment of a bow sight, whereas the sight window is located at the bottom, or lower most end of the sight base, it shows the fiber optic strands wrapped around the bowstring above the sight according to the present invention.
Figure 18:
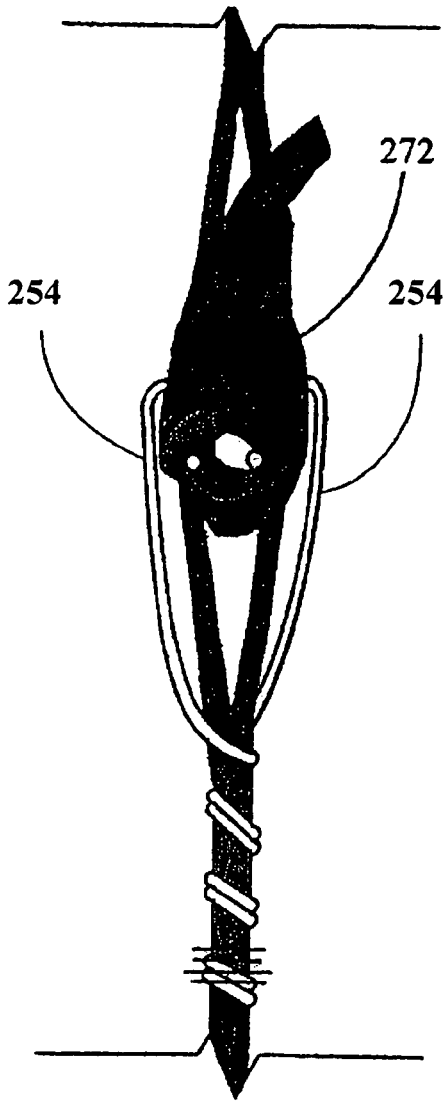
FIG. 18 is a partial view of an eighteenth embodiment of a bow sight showing the fiber optic strands wrapped around the bowstring below the sight according to the present invention.
Figure 19:
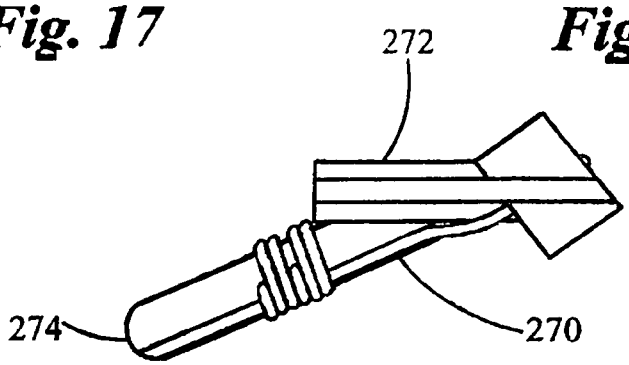
FIG. 19 is a side elevational view of an eighteenth embodiment of a bow sight showing the fiber optic strands wrapped around the sight alignment post of the sight according to the present invention.
Figure 20:
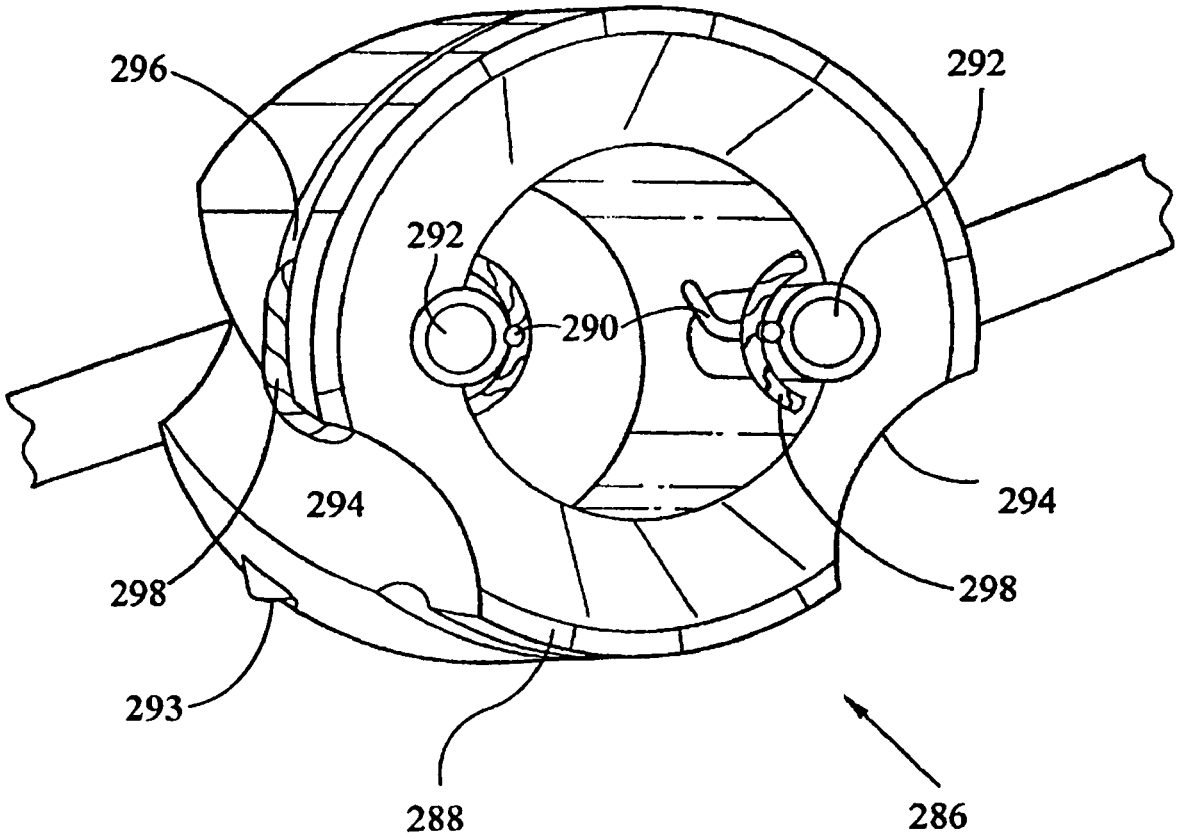
FIG. 20 is a front perspective view of a nineteenth and preferred embodiment of a bow sight according to the present invention.

Attention is now directed to FIGS. 14-19, wherein yet other embodiments of the bow sights are illustrated. These new embodiments utilize wrapped fiber optic strands, which are encased within a flexible clear plastic surgical tubing 254. FIGS. 14 and 17 show the sight bases 256 and 272 respectively utilizing fiber optic strands wrapped and tied to the bowstring above the mounted sights. FIGS. 15 and 18 show these new sight bases 256 and 272 respectively utilizing fiber optic strands wrapped and tied to the bowstring below the mounted sight. This is the preferred method when utilizing smaller compact bows. FIGS. 16 and 19 show side elevational views of sight bases 256 and 272 respectively. These sights utilize fiber optic strands wrapped around posts 258 and 274 respectively in which the alignment cord is affixed. On these sights, the posts 258 and 274 respectively are longer than current state of art posts so as to accommodate the wrapping of the fiber optic strand, or strands 254 and 270 respectively. The fiber optics utilized can be either, two fiber optic strands, or it can be a single individual fiber optic strand. If a single fiber optic strand 254 and 270 respectively is utilized, then each end of the fiber optic strand is used as a sight pin. The latter described option is preferred.

Figure 21:
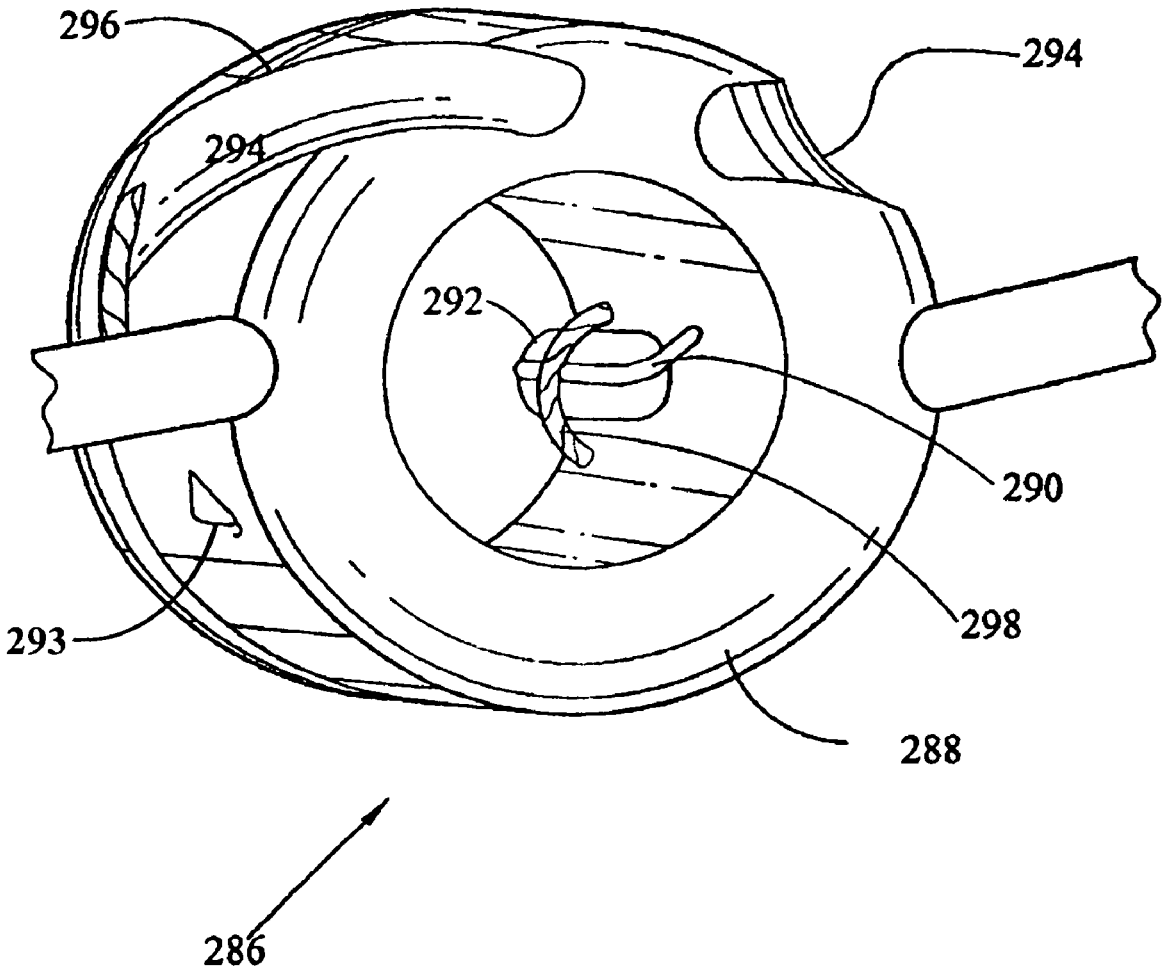
FIG. 21 is a rear perspective view of a nineteenth and preferred embodiment of a bow sight according to the present invention.
Figure 22:
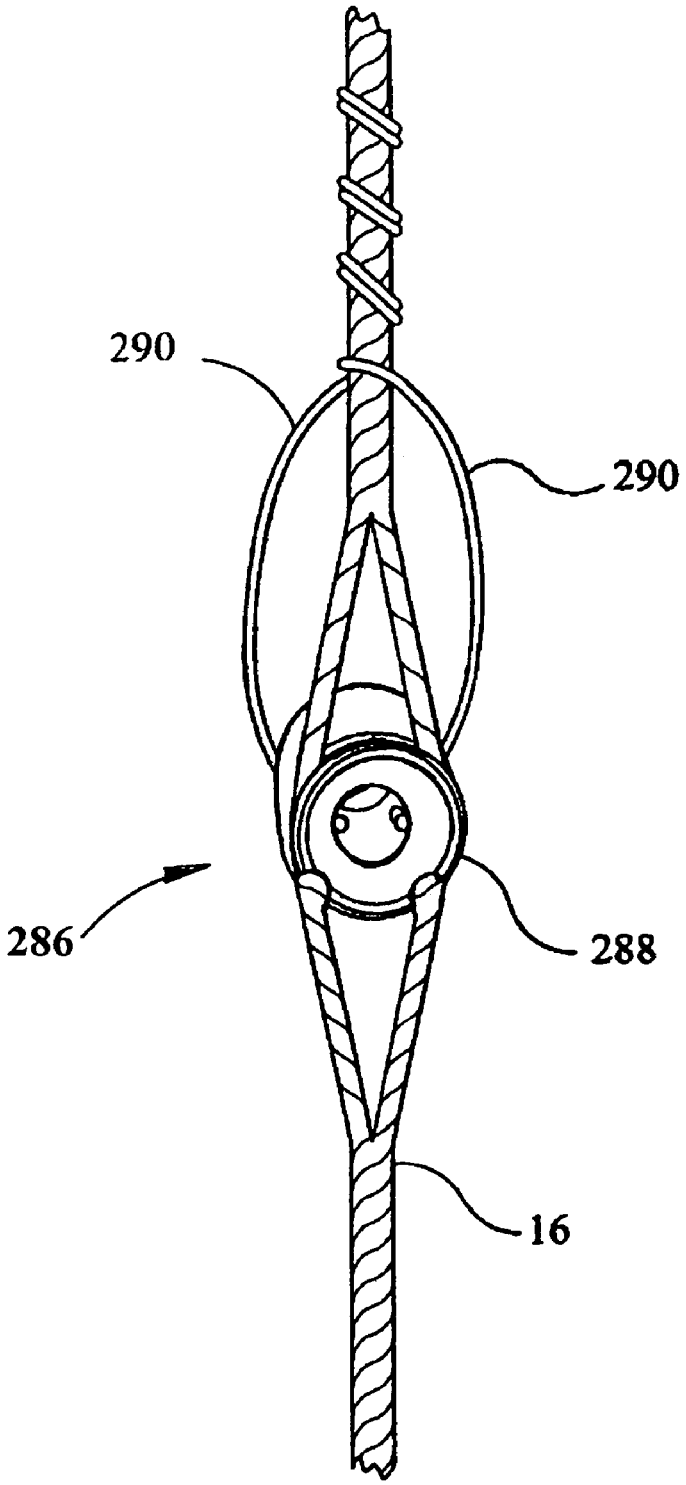
FIG. 22 is a partial view of a nineteenth and preferred embodiment of a bow sight showing the fiber optic strands wrapped around and tied to the bowstring above the sight base according to the present invention.
Figure 23:
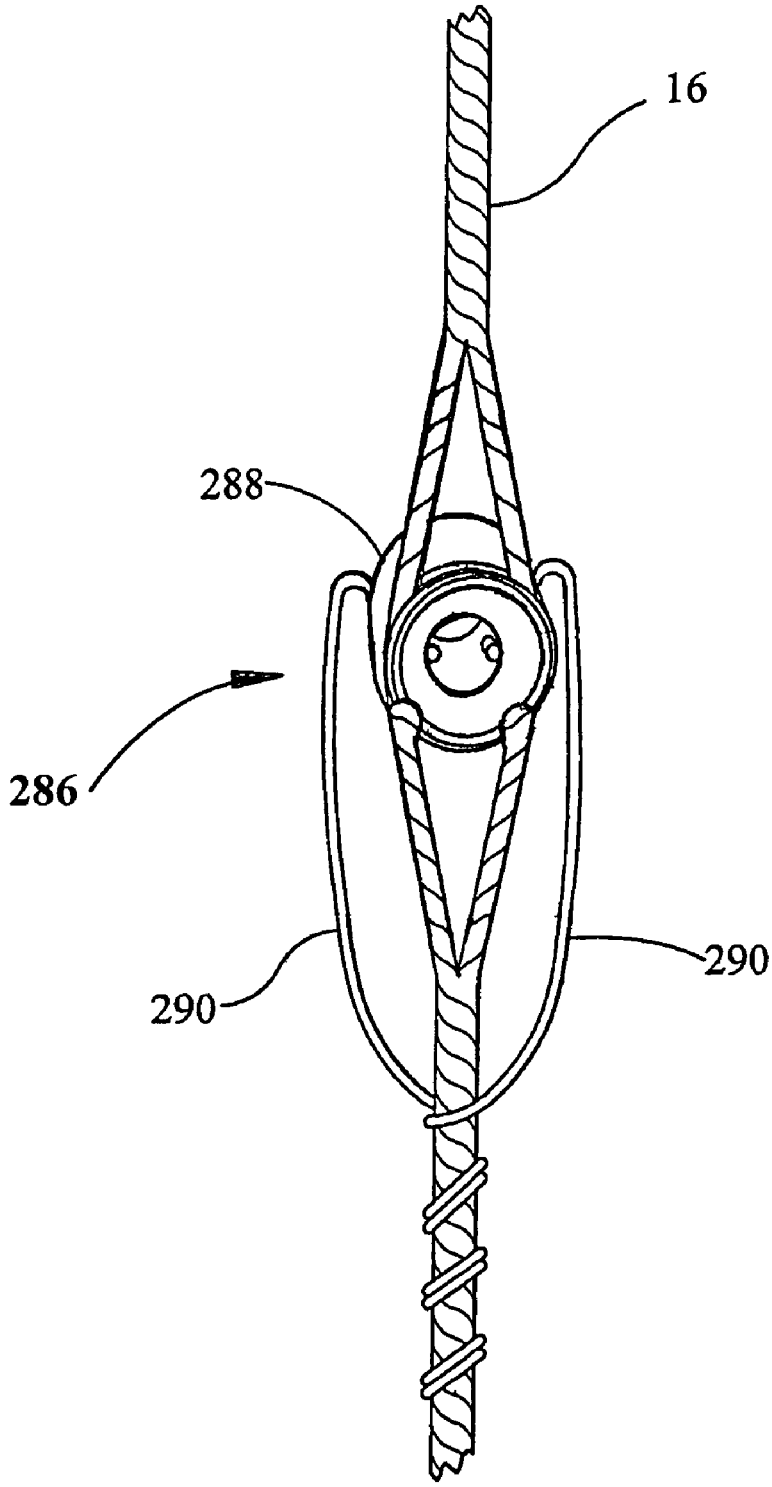
FIG. 23 is a partial view of a nineteenth and preferred embodiment of a bow sight showing the fiber optic strands wrapped around and tied to the bowstring below the sight base according to the present invention.
Figure 24:
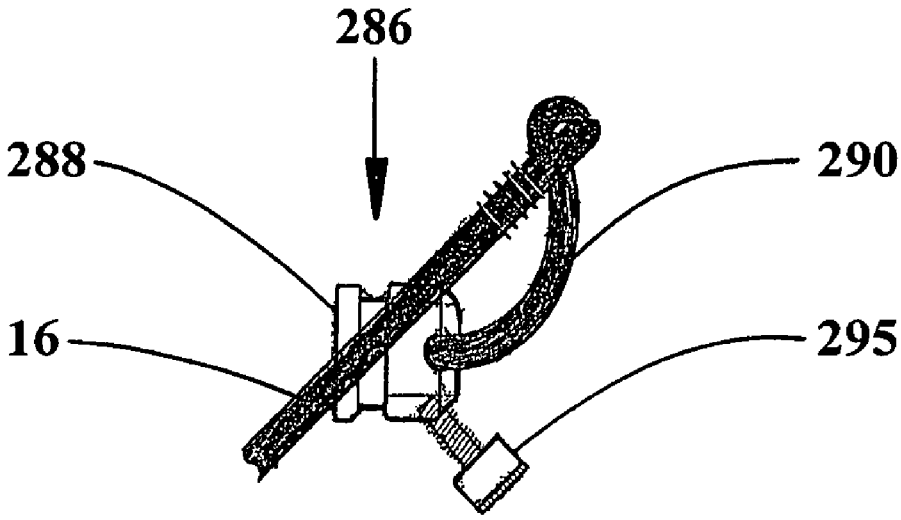
FIG. 24 is a side view of a nineteenth and preferred embodiment of a bow sight affixed to a bowstring, shown at an angle when at full draw, utilizing an optional inserted and securely fastened screw in the bottom of the sight base for alignment.
Figure 25:
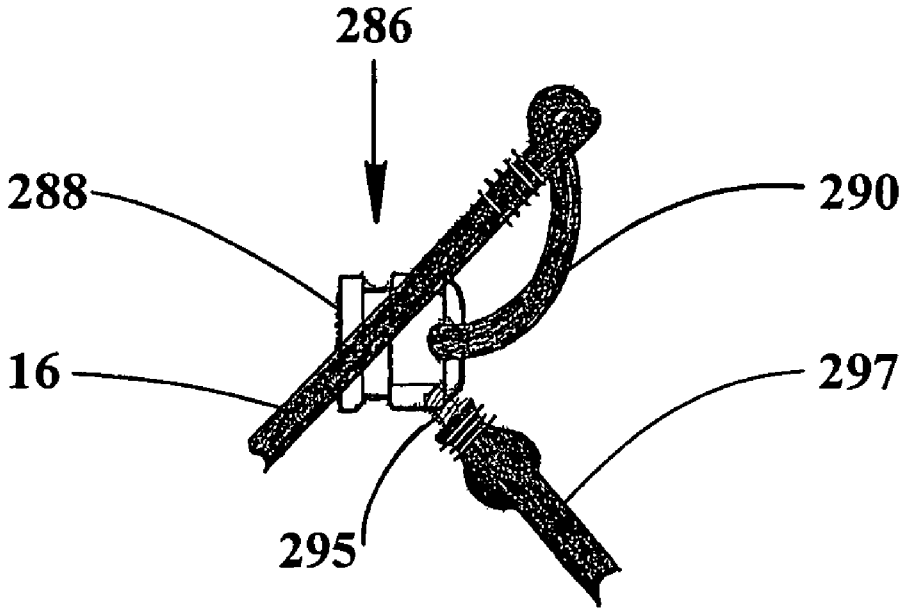
FIG. 25 is a side view of a nineteenth and preferred embodiment of a bow sight affixed to a bowstring, shown at an angle when at full draw, utilizing an optional inserted and securely fastened screw in the bottom of the sight base for sight alignment, with an elastic alignment cord affixed.

Attention is now directed to FIGS. 20-25 which illustrate the preferred embodiment of the invention. The preferred bow sight is generally indicated at 286 and utilizes fiber optic strands encased within a flexible clear plastic surgical tubing. Sight 286, incorporates a sight window as in the above embodiments. Additionally, the circular sight window hole within the center of sight 286 can be tapered, wherein the forward diameter side of the sight window is smaller in diameter than that of the rear side diameter. Both fiber optics and tritium night sights are employed to enhance sighting. Fiber optic sights will dim in brilliance when ambient light becomes very low. In these low light situations, tritium sights will become brighter and permit proper sight alignment. Fiber optic sight holes are drilled in the bow sight base 288 and at least two colored fiber optic strands 290 inserted therein. Tritium sight holes 292 are positioned adjacent the fiber optic sight holes. Base 288 is fabricated from 6061-T6 aircraft-grade aluminum and is anodized. Diagonal notches 294 are provided adjacent to each other, and function to hold the sight base 288 at its proper angle when sight 286 is properly positioned, between the two equaled divisions of the bowstring. Once properly positioned a groove or notch 296 around the periphery of the sight base 288 will serve to hold string, so as to tie and permanently secure sight 286 to bowstring. Before being permanently tied, notch 296 also serves to support the tritium night sights and fiber optic sights to be tied. Once properly tied with appropriate string 298 on each adjacent side, bow string 298 can then be wrapped around sight base 288. The string will go into notch 296, which in turn will cover the bowstring divisions, and the tied string used to secure the tritium night sights and the fiber optic sights. The bowstring should also be tied above and below the sight base 288. After this is complete, installation of sight 286 is complete, with the exception of still having to wrap and tie the fiber optic strands in place. Depending on preference, the fiber optic strands 290 can be wrapped and tied either above or below installed sight base 288. FIG. 21 shows sight 286 from the rear side of the sight window. FIG. 22 shows sight 286 mounted with the fiber optic strands 290 wrapped and tied above the mounted sight base 288. FIG. 23 shows sight 286 mounted with the fiber optic strands 290 wrapped and tied below the mounted sight base 288. FIG. 24 shows sight 286 mounted on a bowstring 16, at an angle when at full draw. Sight 286 has an optional alien screw with thread locker 295 inserted and securely fastened into a predrilled hole in the center bottom portion of sight base 288. FIG. 25 shows sight 286 mounted on a bowstring 16 wherein sight 286 has an affixed elastic alignment cord 297 affixed to the mounted alien screw 295. Other end of alignment cord is affixed to either the forward cable system, or limb of the bow.

Figure 26:
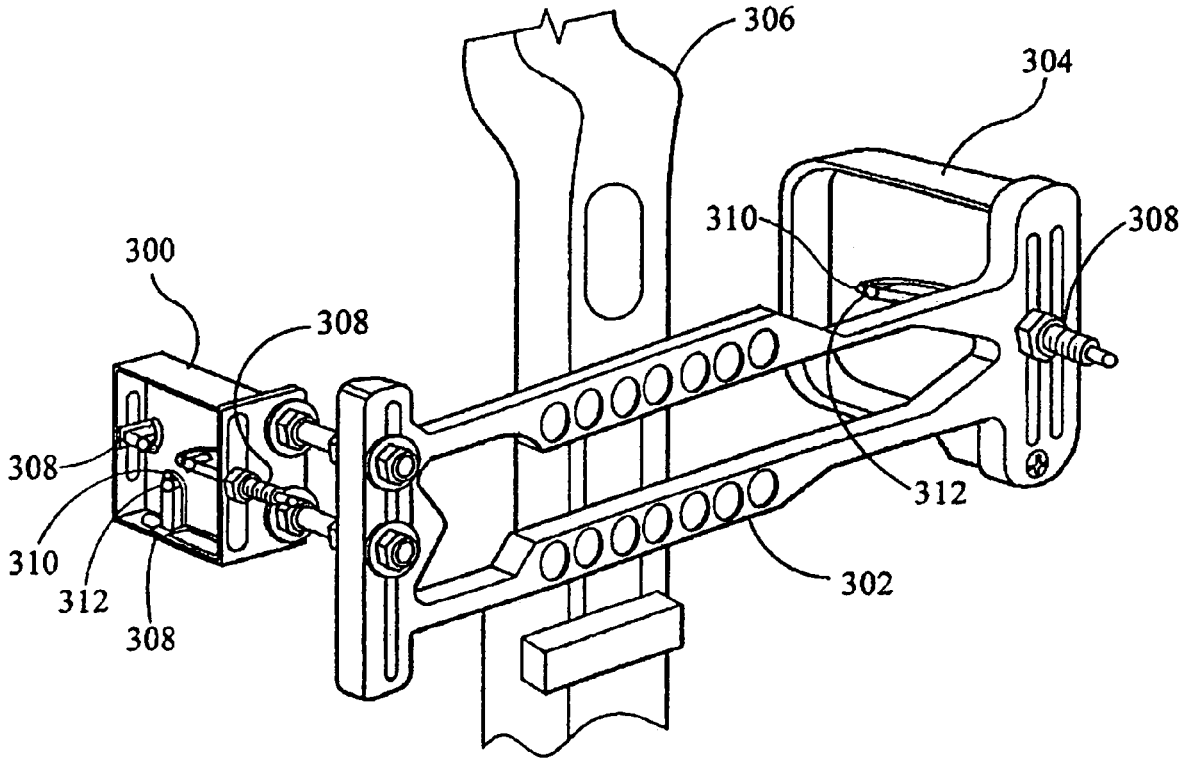
FIG. 26 is a perspective view of a twentieth embodiment of a sight arrangement mounted to a universal mounting bracket according to the present invention.

FIG. 26, is illustrative of another style or type of sight configuration, and shows a rear bow sight 300 attached to a universal mounting bracket 302 which includes a forward sight 304. Universal mounting bracket 302 is mounted to bow riser 306. Each fiber optic sight pin is combined with a tritium night sight thus making up one complete sight 308. In sight configuration four sights 308 are utilized, in sight 300 for the rear sight, three sights 308 are utilized and one sight 308 is utilized for the forward sight 304. Fiber optic sight pins 310 and tritium night sights 312 are oriented in the respective sights to allow brighter illumination points toward the center of the sight. The forward fiber optic sight pin 310 is to the innermost center, while the tritium night sight 312 is directly next to, and in fact touches the fiber optic sight pin 310. In this embodiment, the forward sight 304 is identical to the rear sight 300. The sight pins can be fabricated from optical grade resins, or they can utilize current state of art fiber optic strands, with the tritium night sights 312 imbedded directly next to the fiber optic sight pin 310.

Figure 27:
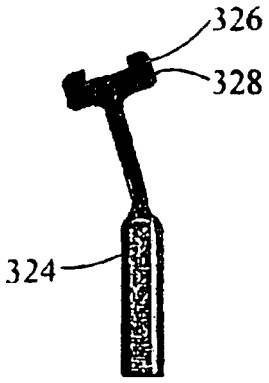
FIG. 27 is a side view of a forward fiber optic bow sight pin utilizing a tritium night sight according to the present invention.

FIG. 27, shows a side elevational view of a vertical forward bow sight pin 324, constructed of current state of art hard metal. The very top portion is used to support the fiber optic strand, or an injection molded fiber optic sight pin 326. Directly beneath sight pin 326, and in fact just touching the fiber optic sight pin 326, is the tritium night sight 328, which is new to this invention.

Figure 28:
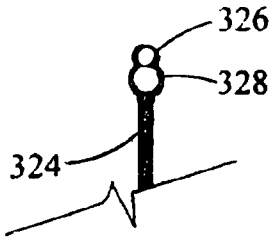
FIG. 28 is a front view of a forward fiber optic bow sight pin utilizing a tritium night sight according to the present invention.

FIG. 28 shows a front elevational view of the same vertical forward bow sight pin 324 mentioned above. Therefore, it also is constructed of current state of art hard metal. Again, the very top portion is used to support the fiber optic strand, or an injection molded fiber optic sight pin 326. Directly beneath sight pin 326, and in fact just touching the fiber optic sight pin 326, is the tritium night sight 328. The view is shown so as to better see what a shooter is looking at when in a firing position.

Figure 29:
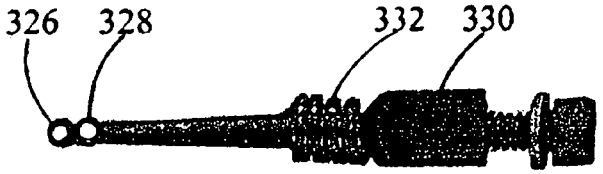
FIG. 29 is a front view of a forward fiber optic bow sight pin wherein the fiber optic strand is wrapped around the sight pin base, and in combination is shown utilizing a tritium night sight according to the present invention.

FIG. 29 shows a front elevational view of a typical forward fiber optic bow sight pin 330, whereas the fiber optic strand 332, is wrapped around the sight pin base. The sight is constructed of current state of art hard metal. In this view, the far left portion is used to support the fiber optic strand 326, or an injection molded fiber optic sight pin 326. Directly to the right of sight pin 326, and in fact just touching the fiber optic sight pin 326, is the tritium night sight 328.

Figure 30:
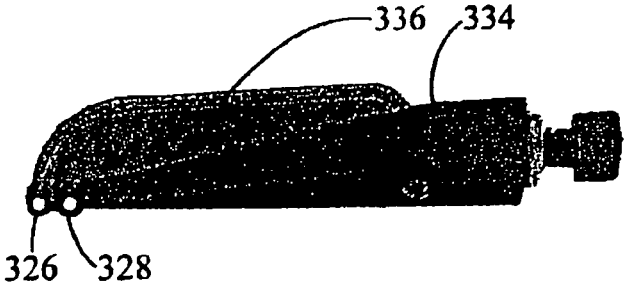
FIG. 30 is a perspective view of a forward fiber optic bow sight pin wherein the fiber optic strand goes through the sight pin base, and in combination is shown utilizing a tritium night sight according to the present invention.

FIG. 30, shows a front perspective view of a typical forward fiber optic bow sight pin 334, wherein the fiber optic strand 336, is wrapped in a U shape, and encased in acrylic directly behind the sight base. This sight base is constructed of current state of art hard metal. In this view the far left portion is used to support the fiber optic strand 326, or an injection molded fiber optic sight pin 326. Directly to the right of sight pin 326, and in fact just touching the fiber optic sight pin 326, is the tritium night sight 328.

Figure 31:
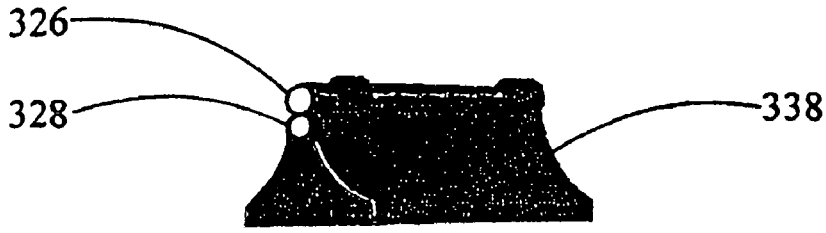
FIG. 31 is a perspective view of a forward fiber optic sight, for use with firearms utilizing fixed sights, and in combination is shown utilizing a tritium night sight according to the present invention.

FIG. 31, shows a front perspective view of a typical forward firearm sight 338 (firearms refer to: pistols, shotguns, or rifles that utilize fixed sights—firearms not utilizing scopes, or sighting systems of the like). The fiber optic sight pin 326, is at the very top. This sight is constructed of current state of art hard metal. Directly beneath the fiber optic sight pin 326, and in fact just touching the fiber optic sight pin 326, is the tritium night sight 328.

Figure 32:
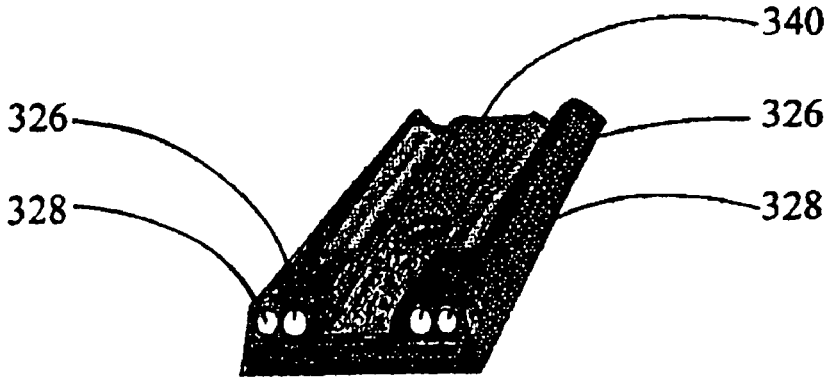
FIG. 32 is a perspective view of a rear fiber optic sight, for use with firearms utilizing fixed sights, and in combination is shown utilizing a tritium night sight according to the present invention.

FIG. 32 shows a front perspective view of a typical rear firearm sight 340. The fiber optic sight pins 326, are to the innermost center of the sight 340. The sight 340 is constructed of current state of art hard metal. Directly positioned to the outermost adjacent sides respectively, and just touching the fiber optic sight pins 326, are the tritium night sights 328.

Figure 33:
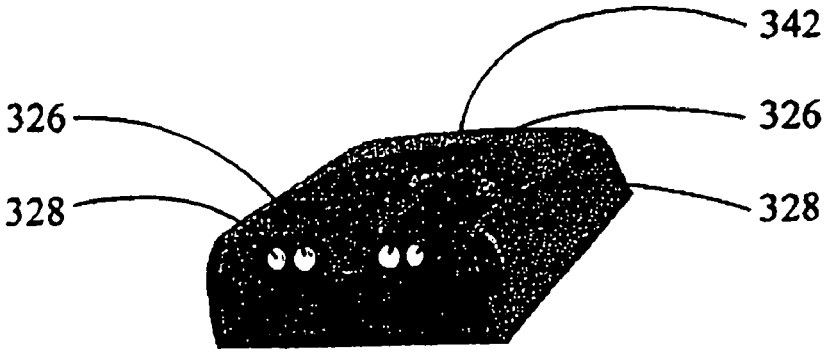
FIG. 33 is a perspective view of another style of a rear fiber optic sight, for use with firearms utilizing fixed sights, and in combination is shown utilizing a tritium night sight according to the present invention.

FIG. 33, shows a front perspective view of another typical rear firearm sight 342. The fiber optic sight pins 326 are to the innermost center of the sight 342. However, instead of two individual fiber optic sight pins, or strands, used for each individual sight pin, there is only one fiber optic strand utilized—in which, each end serves as an individual fiber optic sight pin. This sight 342 is constructed of current state of art hard metal. Directly positioned to the outermost adjacent sides respectively, and just touching the fiber optic sight pins 326, are the tritium night sights 328.

It is to be understood that the present invention is not limited to the embodiments described above, but encompasses any and all embodiments within the scope of the following claims.

I claim:

1. A transparent rear bow sight system for a bow having a multiple stranded bowstring comprising:

a base member, said base member having a peripheral edge defining at least two holes;

a circular transparent sight window centrally disposed within said peripheral edge;

at least two fiber optic strands having first ends inserted into the at least two holes and second ends extending beyond the peripheral edge of said base member;

at least two tritium night sights supported within the peripheral edge of said base member and positioned adjacent the first ends of said at least two fiber optic strands; and notches positioned around said peripheral edge for securing said base member to said bowstring.

2. The transparent rear bow sight system for a bow having a multiple stranded bowstring according to claim 1, wherein said base member is fabricated from, 6061-T6 aircraft-grade aluminum.

3. The transparent rear bow sight system for a bow having a multiple stranded bowstring according to claim 1, wherein said fiber optic strands are colored.

4. The transparent rear bow sight system for a bow having a multiple stranded bowstring according to claim 1, wherein the second ends of said at least two fiber optic strands are attached to said bowstring.

5. A transparent rear bow sight system for a bow having a multiple stranded bowstring comprising:

an anodized base member fabricated from 6061-T6 aircraft-grade aluminum, said base member having a peripheral edge defining at least two holes;

a circular transparent sight window centrally disposed within said peripheral edge;

at least two fiber optic strands having first ends inserted into the at least two holes and second ends extending beyond the peripheral edge of said base member;

at least two tritium night sights supported within the peripheral edge of said base member and positioned adjacent the first ends of said at least two fiber optic strands; and notches positioned around said peripheral edge for securing said base member to said bowstring.

6. The transparent rear bow sight system for a bow having a multiple stranded bowstring according to claim 5, wherein said fiber optic strands are colored.

7. The transparent rear bow sight system for a bow having a multiple stranded bowstring according to claim 5, wherein the second ends of said at least two fiber optic strands are attached to said bowstring.

8. The transparent rear bow sight system for a bow having a multiple stranded bowstring according to claim 7, wherein the second ends of said at least two fiber optic strands are attached to said bowstring above said base member.

9. The rear bow sight system for a bow having a multiple stranded bowstring according to claim 7, wherein the second ends of said at least two fiber optic strands are attached to said bowstring below said base member.

* * * * *